US009460884B2

(12) United States Patent
Hopwood et al.

(10) Patent No.: US 9,460,884 B2
(45) Date of Patent: Oct. 4, 2016

(54) MICROPLASMA GENERATING ARRAY

(75) Inventors: Jeffrey A. Hopwood, Needham, MA (US); Chen Wu, Shanghai (CN); Alan R. Hoskinson, Watertown, MA (US); Sameer Sonkusale, Arlington, MA (US)

(73) Assignee: Trustees of Tufts College, Medford, MA (US)

( * ) Notice: Subject to any disclaimer, the term of this patent is extended or adjusted under 35 U.S.C. 154(b) by 172 days.

(21) Appl. No.: 14/235,510

(22) PCT Filed: Jul. 26, 2012

(86) PCT No.: PCT/US2012/048268
§ 371 (c)(1),
(2), (4) Date: Jan. 28, 2014

(87) PCT Pub. No.: WO2013/016497
PCT Pub. Date: Jan. 31, 2013

(65) Prior Publication Data

US 2014/0159571 A1 Jun. 12, 2014

Related U.S. Application Data

(60) Provisional application No. 61/512,739, filed on Jul. 28, 2011.

(51) Int. Cl.
*H01J 7/46* (2006.01)
*H05H 1/24* (2006.01)

(52) U.S. Cl.
CPC ..... *H01J 7/46* (2013.01); *H05H 1/2406* (2013.01); *H05H 2001/2425* (2013.01)

(58) Field of Classification Search
USPC ..... 315/39
See application file for complete search history.

(56) References Cited

U.S. PATENT DOCUMENTS 5,017,404 A 5/1991 Paquet et al.
5,406,238 A * 4/1995 Suzuki ..... H01P 7/082 333/219

(Continued)

FOREIGN PATENT DOCUMENTS

JP 2004-128159 4/2004
JP 2004-220935 A 8/2004

(Continued)

OTHER PUBLICATIONS

Jaeho Kim, Makoto Katsurai, Dongmin Kim, and Hyroyuki Ohsaki; Microwave-excited atmospheric-pressure plasma jets using a microstrip line; Applied Physics Letters 93, 191505 (2008); American Institute of Physic's; Nov. 13, 2008.

*Primary Examiner* — Douglas W Owens
*Assistant Examiner* — Srinivas Sathiraju
(74) *Attorney, Agent, or Firm* — Preti Flaherty; Beliveau & Pachios LLP

(57) ABSTRACT

A microplasma generator includes first and second conductive resonators disposed on a first surface of a dielectric substrate. The first and second conductive resonators are arranged in line with one another with a gap defined between a first end of each resonator. A ground plane is disposed on a second surface of the dielectric substrate and a second end of each of the first and second resonators is coupled to the ground plane. A power input connector is coupled to the first resonator at a first predetermined distance from the second end chosen as a function of the impedance of the first conductive resonator. A microplasma generating array includes a number of resonators in a dielectric material substrate with one end of each resonator coupled to ground. A micro-plasma is generated at the non-grounded end of each resonator. The substrate includes a ground electrode and the microplasmas are generated between the non-grounded end of the resonator and the ground electrode. The coupling of each resonator to ground may be made through controlled switches in order to turn each resonator off or on and therefore control where and when a microplasma will be created in the array.

26 Claims, 24 Drawing Sheets

(56) References Cited

U.S. PATENT DOCUMENTS

| | | | | |
|---|---|---|---|---|
| 5,733,511 | A | 3/1998 | De Francesco | |
| 5,938,854 | A | 8/1999 | Roth | |
| 6,124,592 | A * | 9/2000 | Spangler | G01N 27/624 250/282 |
| 6,211,754 | B1 * | 4/2001 | Nishida | H03B 5/1852 331/107 SL |
| 6,225,879 | B1 * | 5/2001 | Schallner | H01P 7/082 333/205 |
| 6,653,914 | B2 * | 11/2003 | Gapski | H01P 7/084 333/204 |
| 6,917,165 | B2 * | 7/2005 | Hopwood | H05H 1/46 118/723 MP |
| 7,159,536 | B1 | 1/2007 | Grosse et al. | |
| 7,309,842 | B1 * | 12/2007 | Doughty | G01J 3/443 118/723 E |
| 7,915,979 | B2 * | 3/2011 | Chang | H01P 1/2039 333/205 |
| 2004/0164682 | A1 * | 8/2004 | Hopwood | H05H 1/46 315/111.21 |
| 2007/0170995 | A1 * | 7/2007 | Dutton | H05H 1/46 331/107 R |
| 2007/0170996 | A1 * | 7/2007 | Dutton | H01J 37/32192 331/126 |
| 2008/0073202 | A1 | 3/2008 | Lee et al. | |
| 2009/0065177 | A1 | 3/2009 | Ouyang | |
| 2010/0194278 | A1 * | 8/2010 | Ouyang | H01J 37/32366 315/111.21 |
| 2010/0327155 | A1 * | 12/2010 | Lopez-Avila | G01N 27/622 250/282 |
| 2011/0175531 | A1 * | 7/2011 | Urdahl | H05H 1/2406 315/111.21 |
| 2012/0045863 | A1 * | 2/2012 | Hopwood | C23C 16/24 438/57 |
| 2014/0049259 | A1 * | 2/2014 | Poon | G01R 33/34092 324/322 |
| 2014/0159571 | A1 * | 6/2014 | Hopwood | H05H 1/2406 315/39 |

FOREIGN PATENT DOCUMENTS

| | | |
|---|---|---|
| JP | 2008-034735 | 2/2008 |
| KR | 10-0345543 | 7/2002 |
| KR | 10-2008-0043597 | 5/2008 |
| KR | 10-2009-0037438 | 4/2009 |
| KR | 10-2009-0055515 | 6/2009 |
| WO | WO 2010-129277 | 11/2010 |

* cited by examiner

MICROPLASMA GENERATING ARRAY

CROSS-REFERENCE TO RELATED APPLICATION

This application claims priority from U.S. Provisional Patent Application, Ser. No. 61/512,739, filed Jul. 28, 2011 and entitled "Microplasma Generating Array."

STATEMENT REGARDING FEDERALLY SPONSORED RESEARCH OR DEVELOPMENT

The invention was made with support from Grant DE-SC0001923 from the U.S. Department of Energy. The United States Government has certain rights in the invention.

BACKGROUND OF THE INVENTION

As is known in the art, plasma is an ionized gas, in which electrons heated by an electric field are responsible for ionizing gas atoms. At a low gas pressure, the hot electrons inside a plasma have relatively few collisions with the gas atoms. Therefore, the gas remains cool, as one observes in a fluorescent light (p~1 Torr). At or near atmospheric pressure (p~760 Torr), however, the free electrons in the plasma frequently collide with gas atoms and heat the gas to very high temperatures (e.g., 5,000-10,000 K). Examples of atmospheric plasmas include lightning and welding arcs. High temperature plasmas tend to be destructive and are unsuitable for many industrial processes, including photovoltaic manufacturing.

Recently, plasma generators have been developed that produce plasma that is relatively low-temperature at or near atmospheric pressure. These low-temperature, atmospheric-pressure plasmas are known as "cold" plasmas, and are characterized by their lower gas temperatures, often less than 500° K. and generally in the range of 300-1000° K. These cold plasma discharges are not constricted arcs but are typically quite small (<1 mm) and do not cover relatively broad areas of up to 1 $m^2$ as can be required for industrial processes. These low-temperature atmospheric-pressure plasmas, however, are advantageous for numerous industrial processing applications, and in particular for processing inexpensive commodity materials that are sensitive to heat, such as plastics.

An example of a microplasma generator for generating cold plasma at atmospheric pressure is a split ring resonator (SRR). In this device, the microplasma is generated in a discharge gap, e.g., 25 μm, formed in a ring-shaped microstrip transmission line. The cold atmospheric plasma is generated by coupling microwave energy (0.4-2.4 GHz) to plasma electrons using a resonating circuit. The circuit generates high electric fields (E~10 MV/m) that heat the plasma electrons without strong coupling to the rotational and vibrational modes of the gas molecule, i.e., without generating significant heat. The gas temperature within the plasma can be measured using the rotational spectra of nitrogen molecules and is typically in the range of 100-400° C. Exemplary embodiments of SRR plasma generators are described in U.S. Pat. No. 6,917,165 to Hopwood et al., the entire contents of which are incorporated herein by reference for all purposes.

Known microplasma generators employ a microwave resonating circuit to generate a low-temperature atmospheric-pressure plasma. Of the known cold plasma technologies, the microwave resonator approach offers the most intense electron density while maintaining the lowest gas temperature and the longest electrode life.

One drawback to the existing cold plasma generators is that their geometries are not optimized for some industrial processing, particularly processes for altering the surface of a substrate. The SRR device, for example, is limited to a single "point" geometry, that severely limits its effectiveness for processing a wide-area substrate. Quarter-wave microstrip resonators have been demonstrated to generate microplasmas and can be assembled into linear arrays. These arrays do not scale well to sizes of industrial interest, however, as at larger linear array sizes plasma might not be generated by the resonators near either edge of the array.

What is needed, therefore, is a device for generating a microplasma that can be better controlled and tuned for specific applications and that can provide plasma over a larger area.

BRIEF SUMMARY OF THE INVENTION

According to one embodiment of the present invention, a microplasma generator comprises a substrate made from dielectric material with first and second conductive strips disposed on a first surface of the dielectric substrate. The first and second conductive strips are arranged in line with one another with a gap defined between a first end of each strip. A ground plane is disposed on a second surface of the dielectric substrate. A second end of each of the first and second strips is coupled to the ground plane. A power input connector is coupled to the first strip at a first predetermined distance from the second end wherein the first predetermined distance is chosen as a function of the impedance of the first conductive strip.

In another embodiment, a microplasma generator includes first and second pluralities of conductive strips disposed on a first surface of a substrate of dielectric material. Each strip of the first plurality is arranged with respect to a corresponding strip of the second plurality to define a gap between a first end of each corresponding strip. A second end of each strip in the first and second pluralities of strips is electrically coupled to a ground plane disposed on a second surface of the substrate. A power input connector is coupled to at least one strip in the first plurality of strips at a first predetermined distance from the second end of the at least one strip and the first predetermined distance is chosen as a function of an impedance of the at least one strip.

In yet another embodiment, a microplasma generator array has a block of dielectric material with a ground plane disposed on a first surface of the block. A plurality of spaced apart resonators are disposed in the block where the resonators are substantially parallel to one another. A first end of each resonator is electrically coupled to the ground plane and a second end of each resonator is exposed in a second surface of the dielectric block. A power input connector is coupled to at least one of the resonators a first predetermined distance from the first end that is chosen as a function of the impedance of the at least one resonator.

In one embodiment of the microplasma generator array, a ground electrode is disposed on the second surface of the dielectric block where the ground electrode has a plurality of openings corresponding to each resonator and the second end of each resonator is exposed in the corresponding opening.

BRIEF DESCRIPTION OF THE SEVERAL VIEWS OF THE DRAWINGS

Other features and advantages of the present invention will be apparent from the following description of embodiments thereof and from the claims, taken in conjunction with the accompanying drawings, in which:

DETAILED DESCRIPTION OF THE INVENTION

This application claims priority from U.S. Provisional Patent Application, Serial No. 61/512,739, filed Jul. 28, 2011 and entitled "Microplasma Generating Array," the entire contents of which is hereby incorporated by reference in its entirety for all purposes.

Figure 1A:
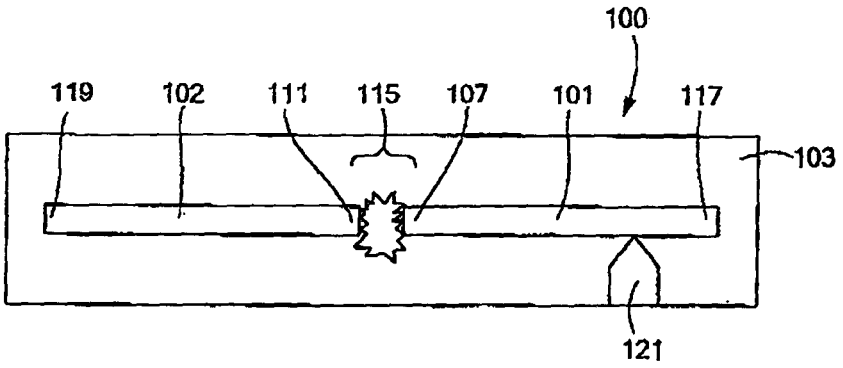
FIGS. 1A and 1B are representations of a microplasma generating array in accordance with one embodiment of the present invention.
Figure 1B:
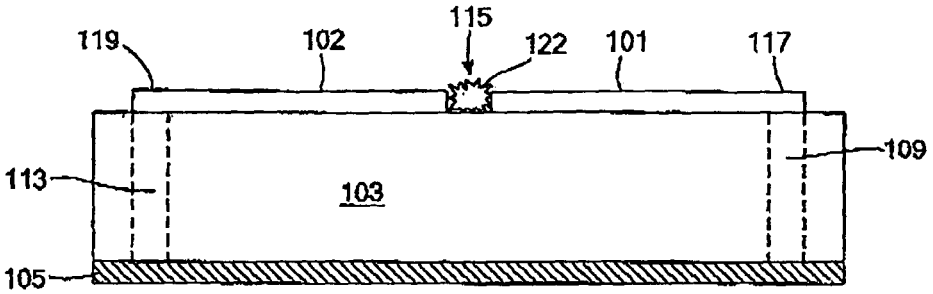

Referring now to FIGS. 1A and 1B, top and side cross-section views, respectively, of a microplasma generator 100 according to one aspect of the invention are presented. The generator 100 in this embodiment comprises first and second strips of metal 101, 102 supported on a first surface of a substrate 103 made of dielectric material. The first and second strips have first ends 107, 111 and second ends 117, 119, respectively. A ground plane 105 is provided on a second surface of the dielectric substrate 103, opposite the metal strip 101. The second end 117 of the first metal strip 101 is connected to the ground plane 105 through a conductive via 109 in the dielectric substrate 103. The second end 119 of the second metal strip 102 is connected to the ground plane 105 through a conductive via 113. A gap 115 is defined in the area between the first end 107 of the first metal strip 101 and the first end 111 of the second metal strip 102.

A direct electrical connection to the ground plane is required. As is known, a via is a connection through the dielectric substrate. Alternately, the connection could be made around the edge of the dielectric by, for example, a metal trace or similar structure.

A source 121 of high frequency power is connected to the first metal strip 101, nominally at a location on the strip 101 where the input impedance matches that of the power supply. In this embodiment, the operating frequency of the power is selected such that the length of the first strip 101 is an odd integer multiple of ¼ of the wavelength (λ), i.e., a "quarter-wave resonator," of the signal traveling on the strip. As will be discussed below, other lengths or arrangements may be chosen in order for a resonant frequency of the device to match the frequency of the voltage signal. When power is applied, a microplasma 122 forms in the gap 115 between the strips 101, 102 due to the electric fields in that region.

Figure 2:
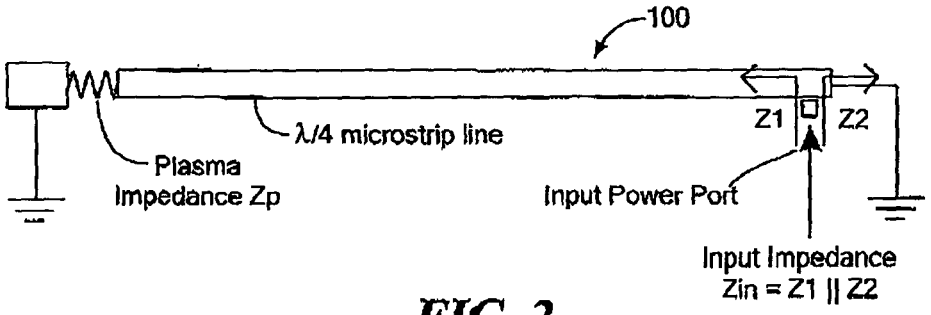
FIG. 2 is an equivalent circuit for calculating impedance at a resonant frequency.

The determination of impedance will now be discussed with reference to FIG. 2 which illustrates an equivalent circuit of a single resonator 100 operated at its resonant frequency. In this circuit, the resonator consists of a microstrip transmission line fabricated on a dielectric substrate. The design is based on a quarter-wavelength resonator, which maximizes the RF voltage difference across a 200 μm discharge gap formed between the end of the resonator and ground.

Here, the microwave power is connected directly to the resonator without a matching network because the physical position of the input port has been chosen to match the power supply impedance (50 Ω). The input impedance of the quarter-wave resonator is based on the equivalent transmission line circuit of FIG. 2 and is calculated by the parallel impedance of the two-line segments ($Z_1 \| Z_2$), which is deduced in the transmission line model of J. Choi et al., *Plasma Sources Sci. Technol.* 18, 025029 (2009), the entire contents of which are incorporated herein by reference. The impedance of the microplasma [$Z_p = R_p + jX_p(\Omega)$] is deduced from the ratio of forward and reflected power ($s_{11}$) versus frequency using the method described in F. Iza and J. Hopwood, *Plasma Sources Sci. Technol.* 14, 397 (2005), the entire contents of which are incorporated herein by reference. In summary, the plasma impedance is complex, with both resistive and capacitive components. In one embodiment, the resonance frequency shifts from $f_0$ to 456 MHz due to plasma sheath capacitance ($X_p$=910 Ω) and the resonance absorption curve broadens due to resistive loading of the resonator by the microplasma ($R_p$=492 Ω).

Figure 3:
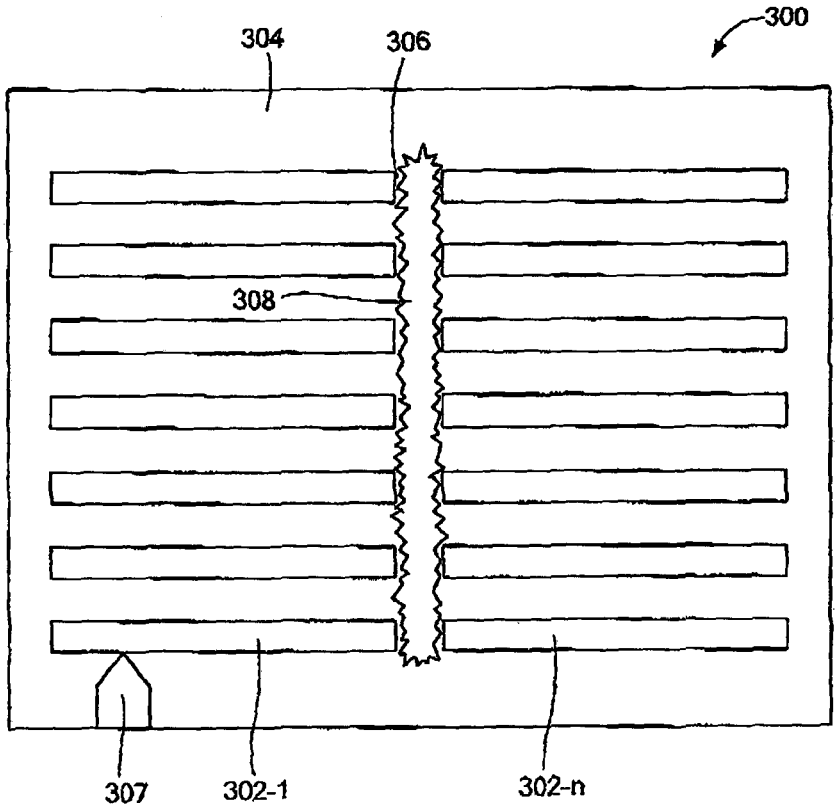
FIG. 3 is a representation of a microplasma generating array in accordance with another embodiment of the present invention.

In one embodiment of a plasma generator, as shown in FIG. 3, a planar microplasma generator 300 includes a plurality of resonating strips or microstrips 302-1 . . . **302-*n* fabricated in close proximity to each other on a surface of a dielectric block 304. It should be noted that a resonating strip 302 may be alternately referred to herein as a "resonator," a "strip" or a "microstrip," without implying any functional difference unless otherwise noted. The arrangement of these strips allows for microplasma formation in a gap 306. At least one of the strips 302-1 has an input or connector 307 for receiving high frequency electrical power. The remaining strips acquire energy due to resonant coupling from the one powered strip to the unpowered strips. The device is constructed to form the microplasma between adjacent resonator tips. The microplasma formed in the gap 306** produces a substantially continuous plasma discharge over an extended area, i.e., a continuous "line" of plasma is produced.

In the embodiment of FIG. 3, the linear microplasma array consists of coupled quarter-wave microstrip resonators 302. The array of strips 302 generates overlapping microplasmas, producing a substantially continuous plasma line 308. For illustration purposes, only fourteen strips 302 are shown, though it will be understood that the array can include more or less strips. In one or more embodiments of the present invention, the array comprises a large number (e.g., ~100 or more) of strips. The strips can be micromachined on an RF circuit board or deposited by any one of many known processes.

Figure 4A:
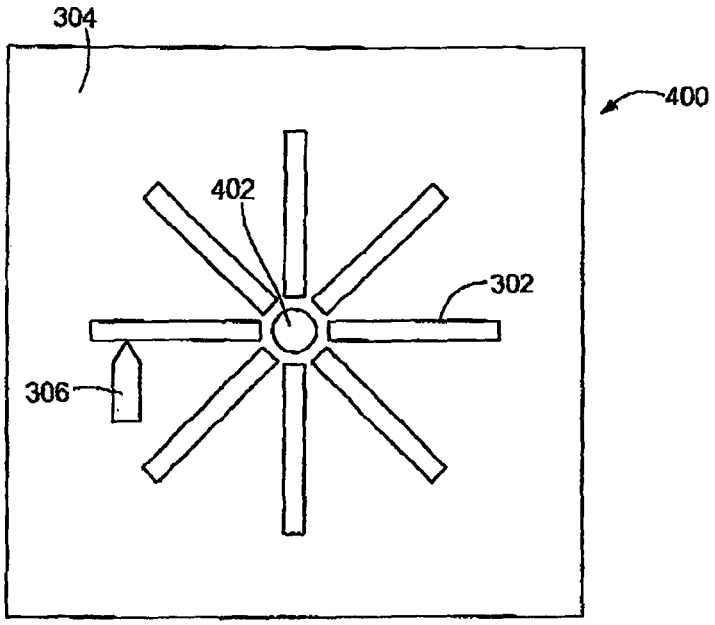
FIGS. 4A and 4B are representations of a microplasma array in accordance with embodiments of the present invention.

In yet another embodiment, as shown in FIG. 4A, a planar microplasma generator 400 has the metal strips 302 in a "hub-and-spoke" arrangement with a central gap 402 in which a plasma is created.

Figure 4B:
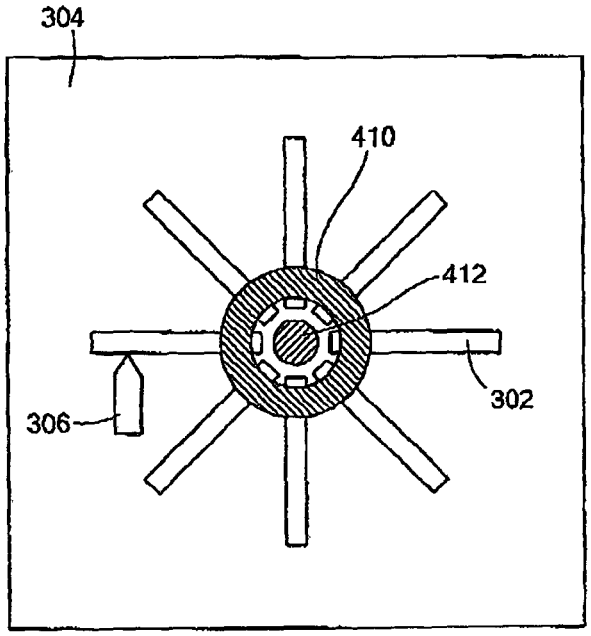

In some instances of operation, the microplasma generator 400 may result in microplasma that migrates outwardly from the center along the resonators resulting in uneven power distribution. To reduce this occurrence, as shown in FIG. 4B, a circular ring 410 and cap 412 made of a dielectric material such as, for example, Duroid® microwave laminate material from Rogers Corporation of Rogers, Conn. are provided. The circular ring 410 and cap 412 cover most of the area adjacent each resonator leaving only the tips exposed.

It is generally impractical to drive each resonator with an individual power source as phase coherency would be lost. Accordingly, in one embodiment, the linear array of resonators is driven from a single power source through the connector 307 with the aid of strong resonant coupling. As known, coupled mode theory provides an accurate model for energy-exchange among resonators. Thus, considering an array of n linear resonators, if one defines the energy stored in the ith resonator as $|a_i|^2$, then the coupling among the n resonators can be expressed to lowest order as:

$$da_i/dt=-j(\omega_i-j\Gamma_i)a_i+j\Sigma_{m\neq i}\kappa_m a_m+F_i,\ (i=1, 2, \ldots, n) \quad \text{(Eq. 1)}$$

where $\omega_i$ is the resonance frequency of the ith resonator in isolation, $\Gamma_i$ is the damping factor, $F_i$ is the external input function, and $\kappa_m$ is the coupling coefficient to the ith resonator from the mth resonator.

If the external inputs $F_i$ are assumed to be small, the solution of the n differential equations in Eq. 1 for an n-resonator system results in n eigenfrequencies for the system of coupled resonators. Power is applied only to any one resonator and the remaining resonators operate through resonant coupling. In order to generate various arrangements of plasma along the array, the resonators can be operated by a superposition of several eigenmodes. The discharge produced by the addition of two or more modes may also demonstrate improved uniformity. This superposition of modes is implemented by combining two or more frequencies from two or more RF signal generators using an RF power combiner and applying this amplified waveform to the first resonator only, as described above.

Figure 5:
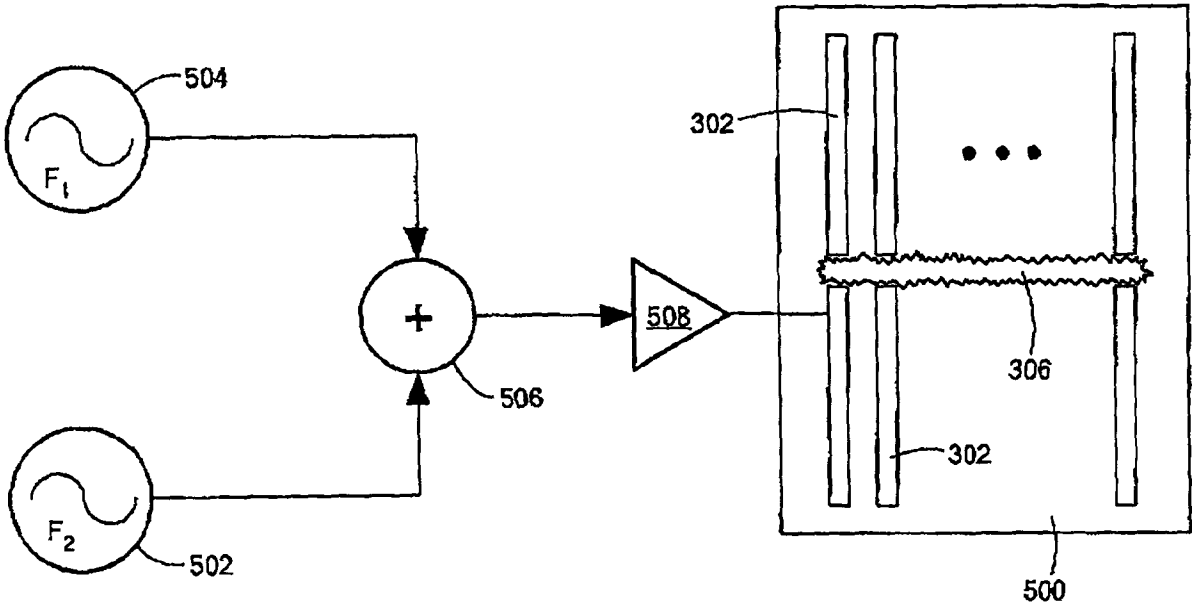
FIG. 5 is a representation of a multi-mode power generator coupled to an embodiment of the microplasma array of the present invention.

With reference to FIG. 5, a microplasma generator array 500 has N modes of operation, where N is the total number of elements or resonators in the array. Each mode has a unique frequency at which the array absorbs microwave power. The mode also has a unique pattern of energy distribution amongst the resonators. As schematically illustrated in FIG. 5, the microplasma generator array 500 may be powered by two RF generator sources 502, 504, operating at, respectively, F1 and F2 frequencies, generally in the hundreds of MHz range, where F2>F1. These frequencies are chosen to correspond to excitation frequencies for respective modes of the microplasma generator array 500. The two signals from the generators 502, 504 are added together in an adder 506 and amplified in an amplifier 508 and applied to the array 500. Of course, one of ordinary skill in the art will understand that the frequency of operation is chosen as a function of the design parameters.

In one approach, the lower frequency F1 excites the resonators located toward the center of the array and the higher frequency F2 excites the resonators towards the ends or edges of the array. It should be noted, however, that the input location is not critical, except some locations will not be 50 ohms. The deliberate superposition of the two or more modes provides a nearly uniform line of microplasmas. In this embodiment, two frequencies are added at the input, where each frequency excites a mode of the array. It will be understood that more than two frequencies can be added at the input. In one embodiment, up to N different frequencies, each corresponding to an excitation frequency of a mode of operation of the array, can be added at the input. In one aspect, the superimposition of mode excitation frequencies improves plasma uniformity.

Microwave resonators have been shown to be an efficient method of generating stable microplasmas in micron-scale electrode gaps. Another embodiment of the present invention is a two-dimensional array of such sources, generating a dense array of microplasmas on a surface. Advantageously, in one embodiment, energy coupling among resonators allows an entire array to be powered by a single microwave power supply. This energy coupling causes a variety of possible operating modes, generating patterned sheets of microplasma.

Figure 6A:
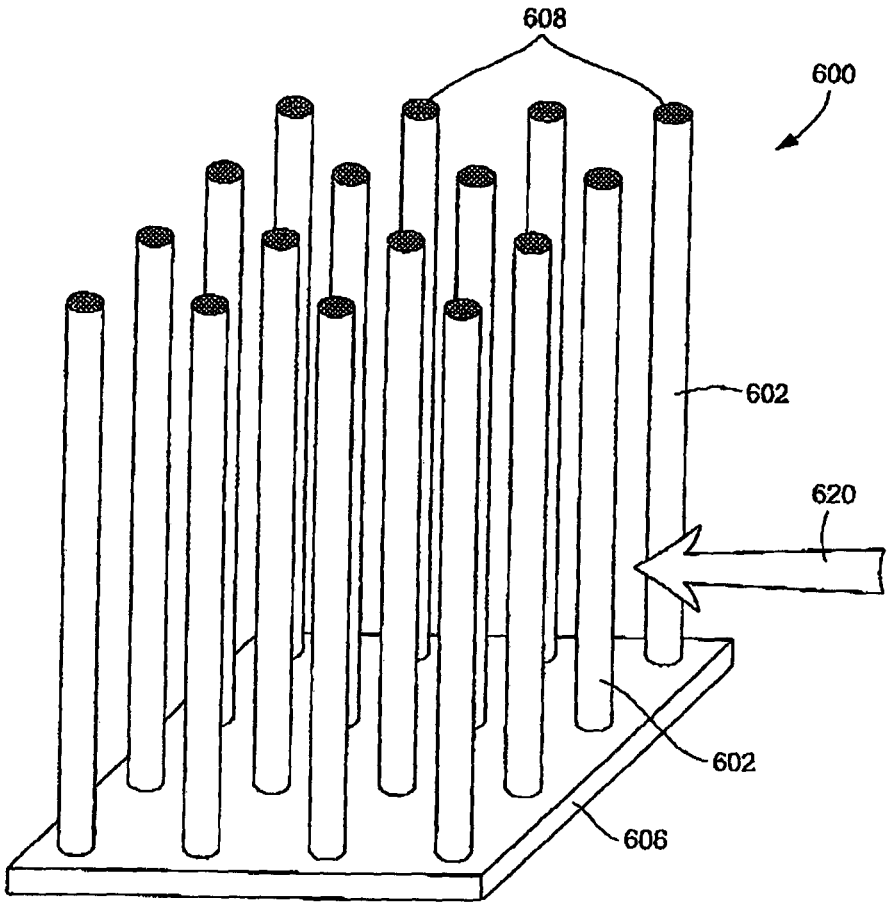
FIGS. 6A-6C are representations of a microplasma array in accordance with another embodiment of the present invention.
Figure 6B:
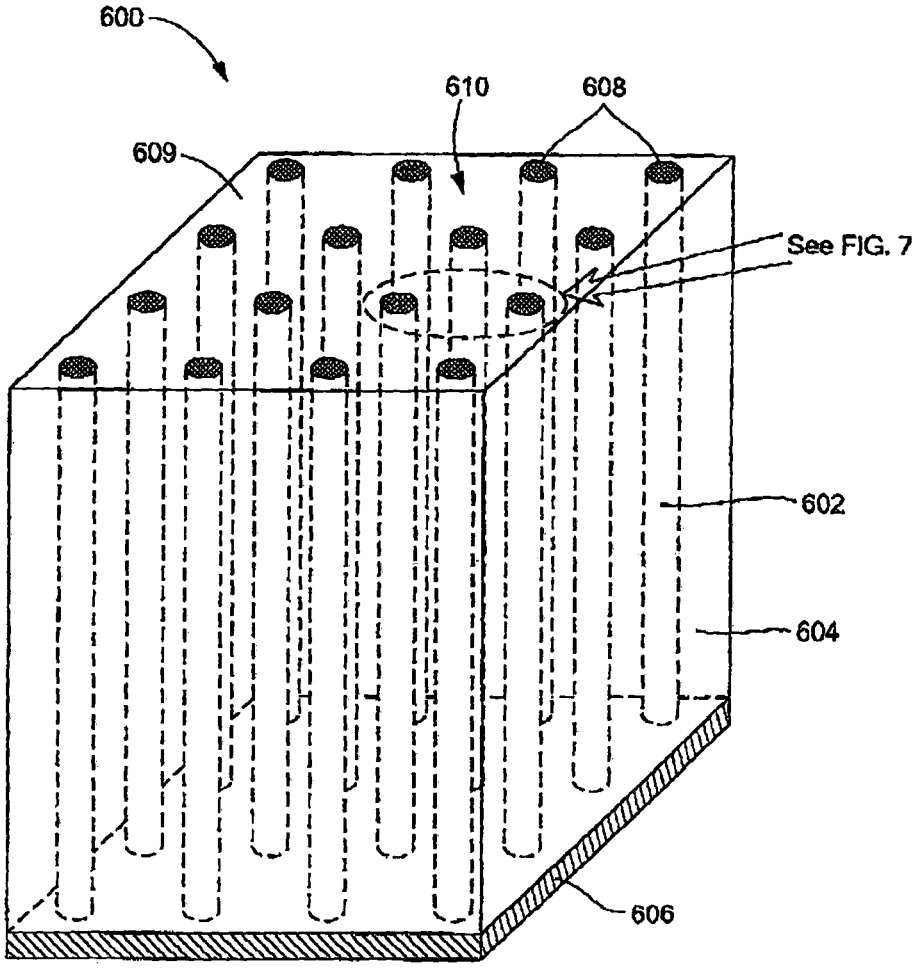
Figure 6C:
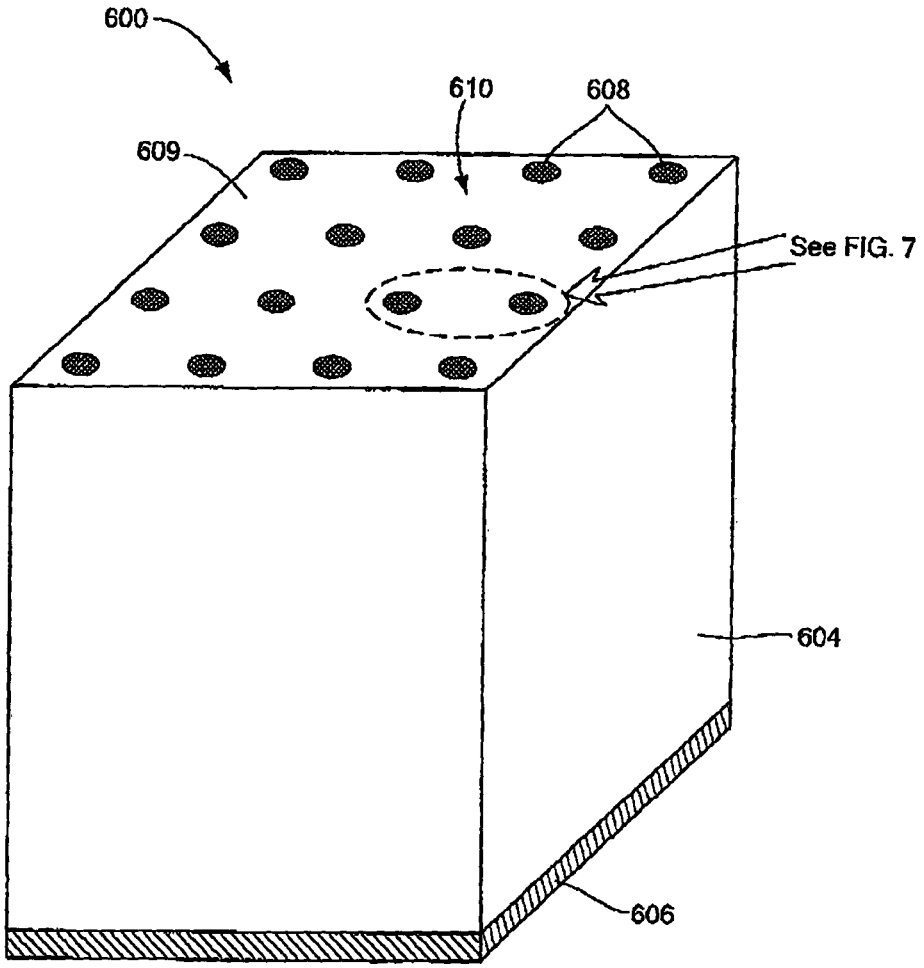
Figure 7:
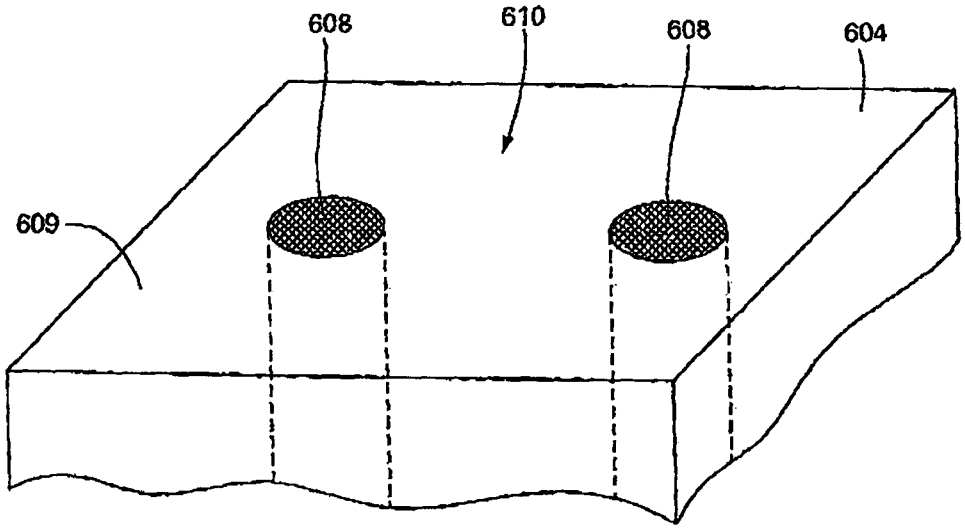
FIG. 7 is a magnified view of a portion of the embodiment of the microplasma array of the present invention shown in FIGS. 6A and 6B.

As shown in FIGS. 6A-6C, a two dimensional (2D) microplasma generator 600 comprises a 2D array of resonators 602 embedded in, or inserted into, a block 604 of a dielectric material, not shown in FIG. 6A. In one embodiment, the resonators 602 may be quarter-wave resonators, i.e., resonators that are an odd integer multiple of a quarter-wave of the input signal. Each resonator 602, in one embodiment, may comprise a wire, however, other structures may be used. As shown, the resonators 602 are arranged in an N×N arrangement although the array is not limited to a "square" arrangement and could include an M×N arrangement where M≠N, or hexagonally symmetric arrangements, as well as other geometries. One end of each resonator 602 is coupled to a ground plane 606 and the other end functions as a resonator tip 608. The resonator tip 608 is flush with a top surface 609 of the block 604. Thus, in one embodiment, a microplasma may be generated in a gap 610 between adjacent resonator tips 608 as shown in FIGS. 6B, 6C and 7. Power 620 is applied to one of the resonators and coupled to the others as described above. The power supply could be directly attached to one of the resonators, or a waveguide or antenna structure could irradiate the block with the appropriate frequency.

Further, two of the 2D generators 600 could be positioned opposite one another to create a plasma between them This arrangement is analogous to that shown in FIG. 3. Such a configuration may be used, for example, simultaneously treat both sides of a sheet of material.

It should be further noted that the reference to a resonant wire is not intended to limit the structure to a wire shape and that other structures or shapes that provide the same functionality may be used. While the cross-section of the resonator is not critical to operation of the device, it appears that symmetric cross-sections may be advantageous, for example, circles, squares, hexagons, etc. over a flat strip.

Figure 8A:
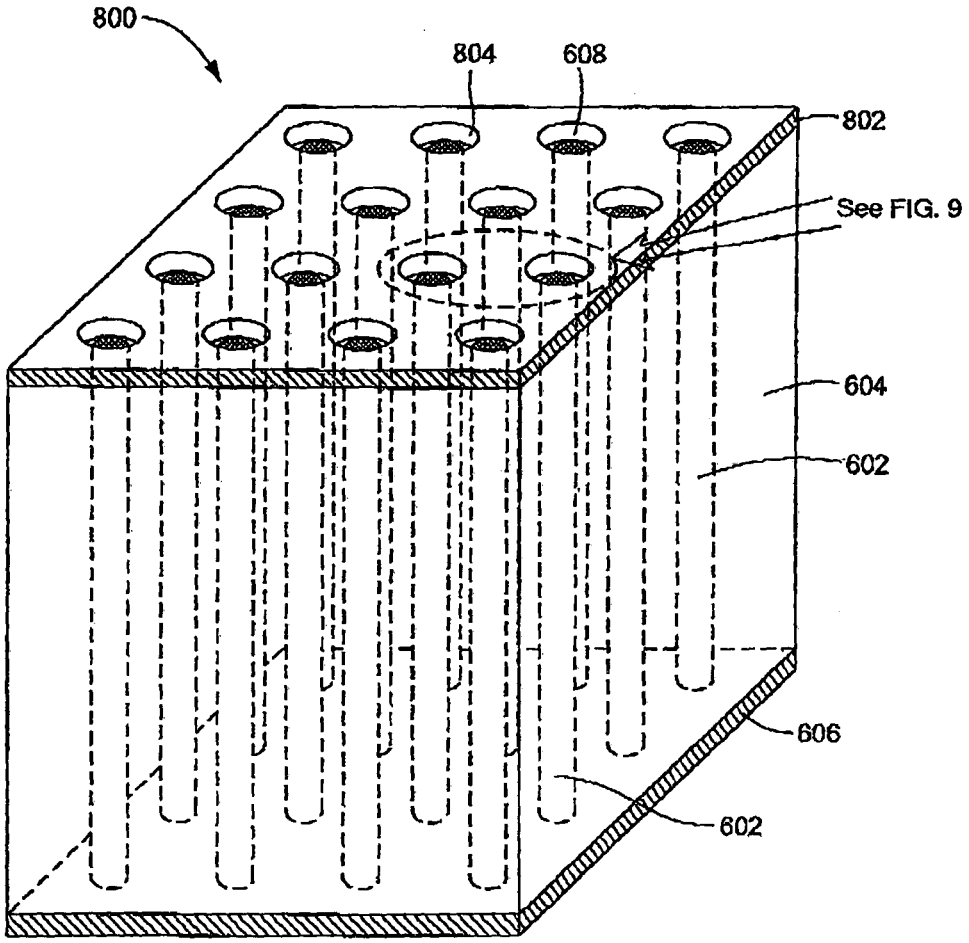
FIGS. 8A and 8B are representations of a microplasma array in accordance with another embodiment of the present invention.
Figure 8B:
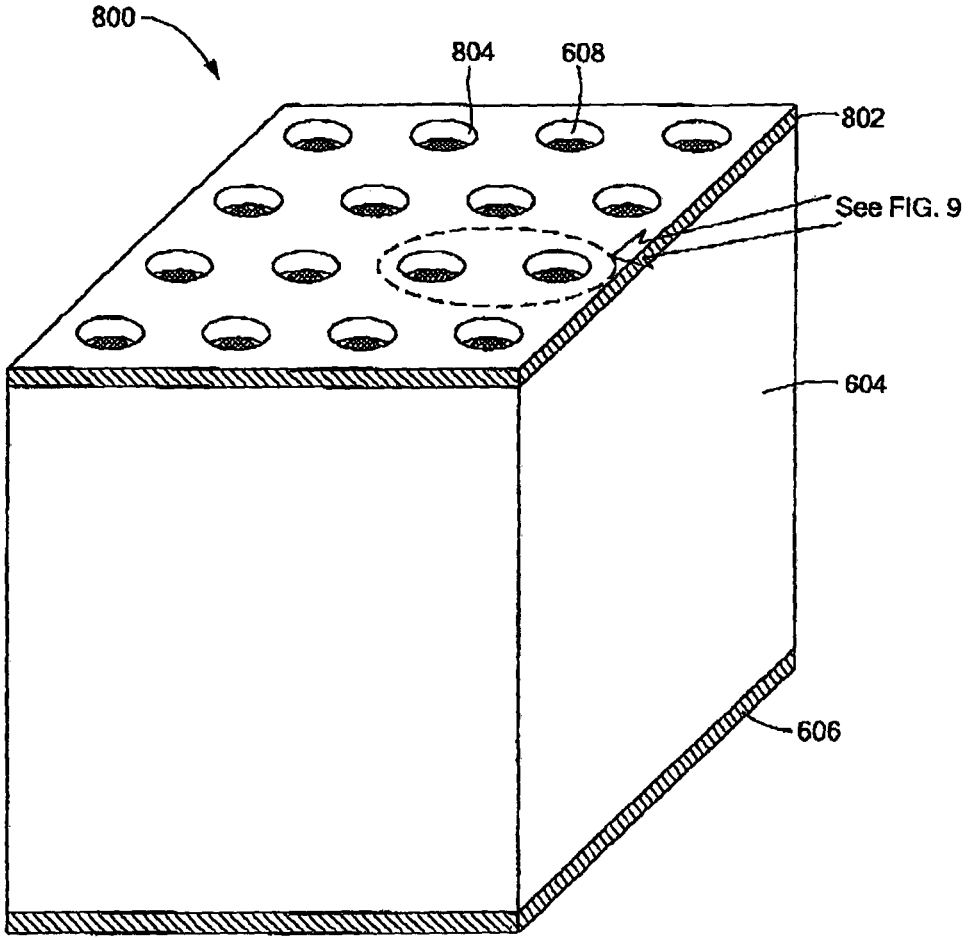
Figure 9:
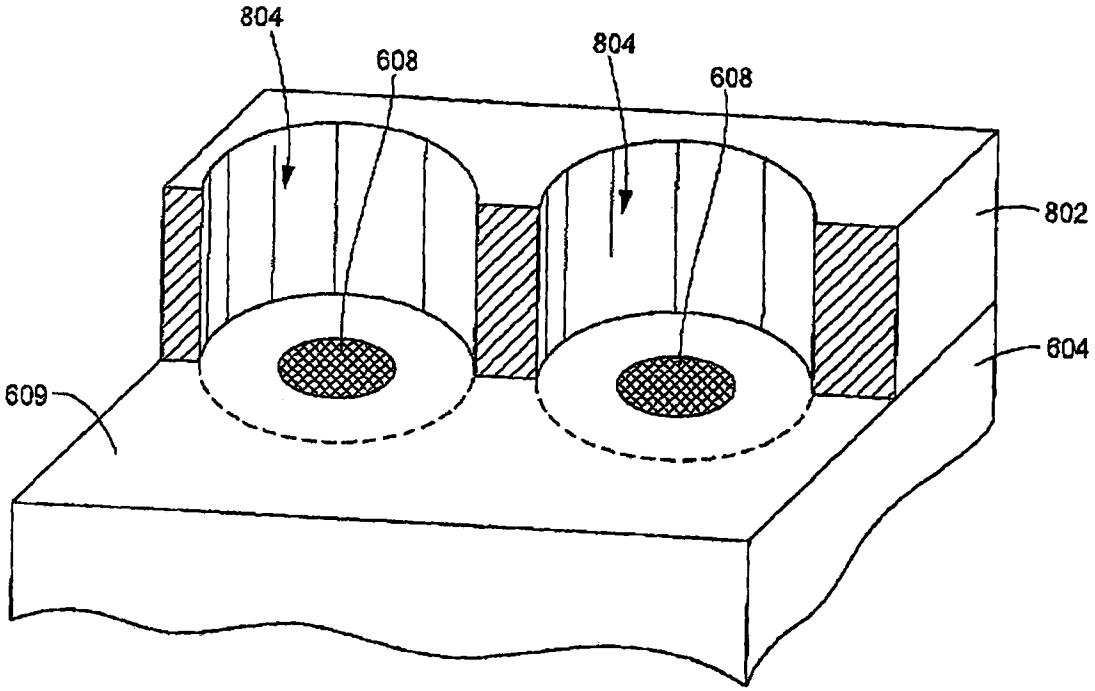
FIG. 9 is a magnified view of the embodiment of the microplasma array of the present invention shown in FIG. 8.

In an alternate embodiment, as shown in FIGS. 8A, 8B and 9, another 2D microplasma generator 800 includes a ground electrode 802 on the surface opposite the ground plane, where a microplasma will be ignited in a well 804 between each resonator tip 608 and the ground electrode 802, as shown in FIG. 9. Similar to the embodiments discussed above in FIGS. 6A-6C and 7, the resonator tip 608 is flush with the surface 609 that defines the bottom of the well 804 or the tip may protrude above surface 609. The total thickness of the device can be scaled down if a higher range of operating frequencies is chosen. By operating near 5 GHz, however, the required length could be less than 5 mm, making for a compact source. The size and spacing of the resonators, and the resulting areal plasma density, is limited only by fabrication capabilities and the ability of the dielectric to dissipate heat from dielectric losses.

Figures 10A, 10B, 10C:
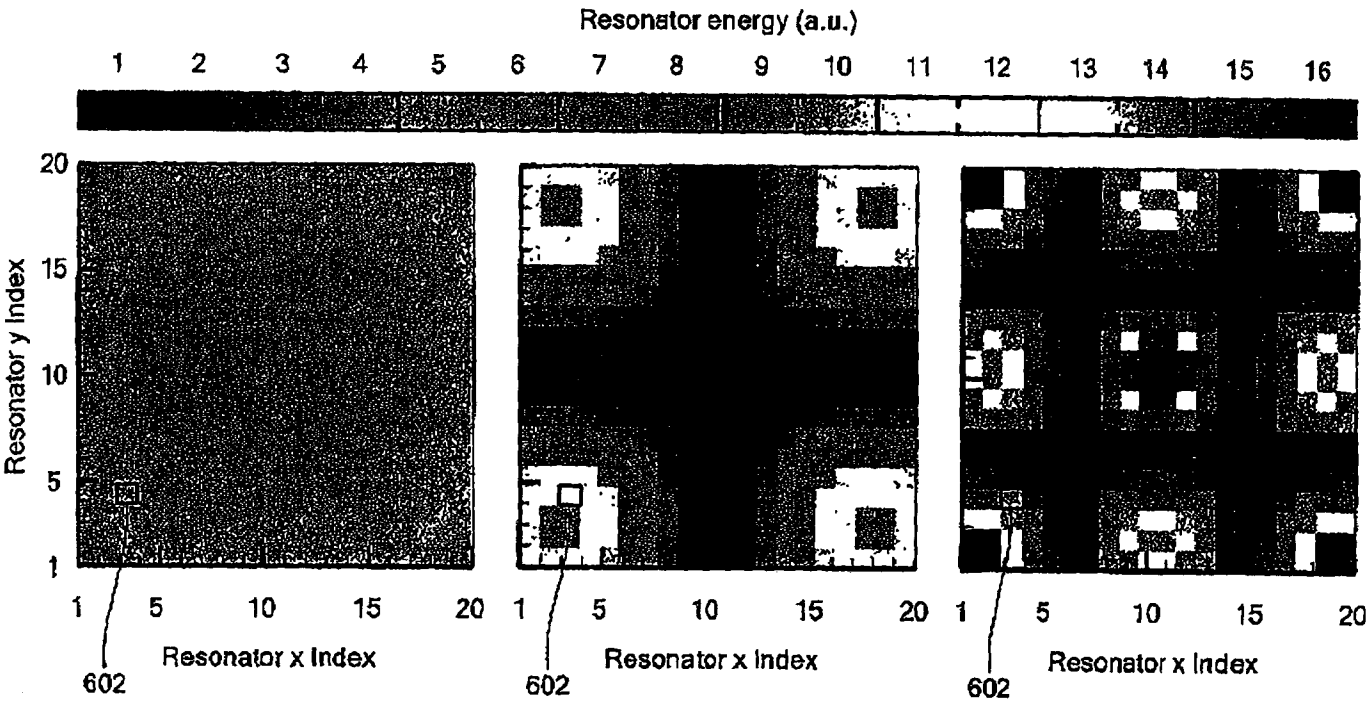
FIGS. 10A-10C are graphs showing predicted mode patterns in accordance with an embodiment of the present invention.

The energy coupling between resonators causes the system resonant frequency to split. The lowest-frequency mode results in a relatively uniform distribution of energy, while non-uniform modes generate plasma only at distinct locations. Several examples of predicted mode patterns are shown in FIGS. 10A-10C. Here, a 20×20 section of resonators 602 is presented as viewed from looking "down" toward the resonator tips 608.

At a first resonant frequency, as shown in FIG. 10A, the plasma energy generated at each resonator 602 is about the same, providing a diffuse pattern of energy at about levels 4-6 on the energy scale. It should be noted that the reference to energy levels is not an absolute value that is intended to be limiting in any way and the energy levels represented on the scale are only intended to reflect relative values.

At the fourth resonant frequency, as shown in FIG. 10B, resonators near the four corners of the array have a higher energy, around levels 12-14, than the other resonators with the lower level energies, about levels 1-3, resulting in a cross-shaped area of lower plasma activity.

At the eleventh resonant frequency, referring to FIG. 10C, resonators near the four corners and the center have the highest energy values, about levels 14-16, and the others have lower values, ranging from 1-3 and resulting in a cross-hatch of lower plasma activity. Rapid switching between mode patterns is accomplished by modulating the input frequency. This ability to switch between different arrangements of microplasmas by switching the input frequency is a novel feature of coupling between resonators and is not exhibited by single resonators. Driving arrays at multiple frequencies results in a superposition of mode patterns and additional patterns are possible, reminiscent of combining elements of a basis set.

As described above, in either a planar array of resonators or a 2D array, power is applied to one resonator and the other resonators acquire energy due to resonant coupling. While this resonant coupling is often sufficient, it can be enhanced by providing electrical connections between adjacent resonators.

Figure 11A:
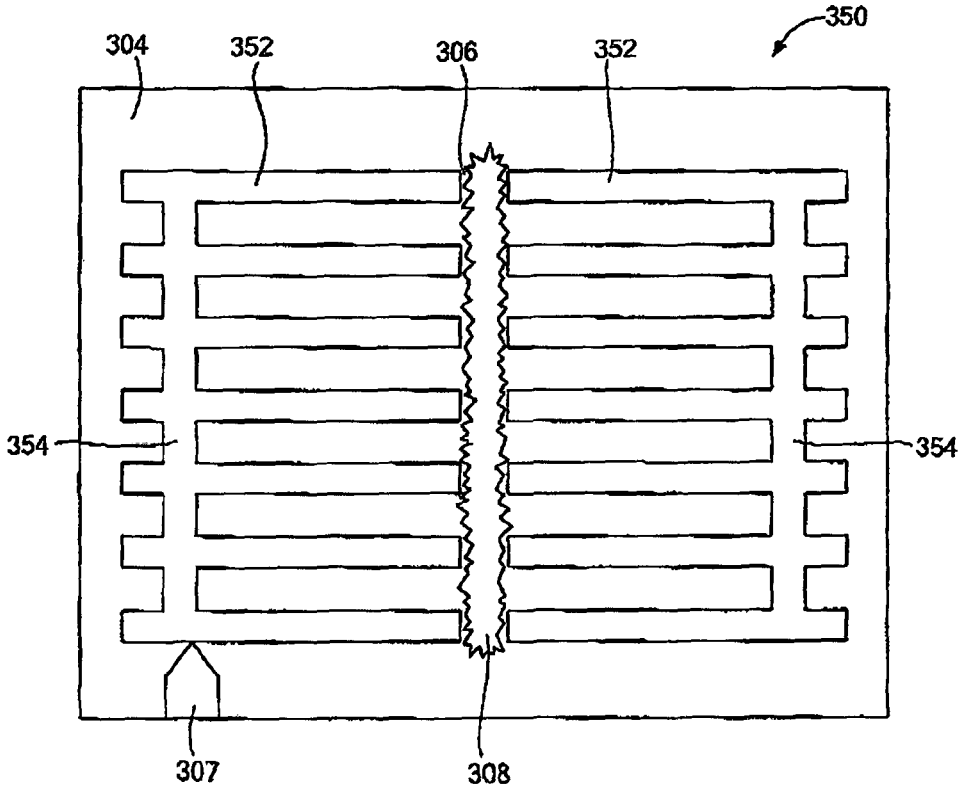
FIGS. 11A-11C are representations of embodiments of a microplasma generator array including a coupling portion.

Referring now to FIG. 11A, a microplasma generating array 350 includes two unitary arrays of resonators 352 where the resonators in each array are coupled to one another by a coupling strip 354. Similar to the array 300 shown in FIG. 3, a gap 306 is provided within which a microplasma 308 is generated. The unitary array 350 may be made by milling a single piece of material. In addition, the array 350 may be made by etching or could comprise separate pieces soldered or welded together and then placed on the dielectric surface.

The coupling strip 354 may be placed anywhere along the length of the resonator 352 and may be co-located with the power input 307. Generally, however, the coupling strip 354 is not located at either end of the resonator 354 as one end, at least with a quarter-wave resonator, is coupled to ground and the plasma is being generated at the other end.

Figure 11B:
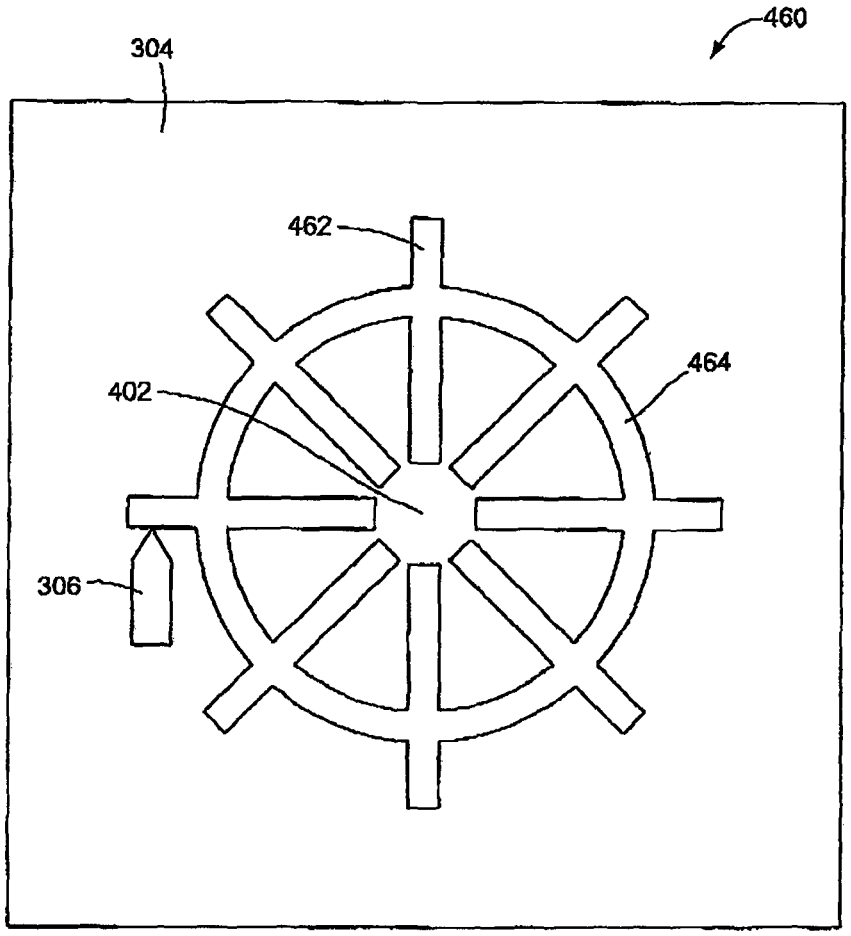

The coupling strip can also be applied to the "hub-and-spoke" embodiment of FIG. 4, as shown in FIG. 11B. Here, an array 460 includes the arranged resonators 462 coupled to one another by a coupling strip 464. The coupling strip may have a width that is either smaller or larger, or the same, as the resonators.

Figure 11C:
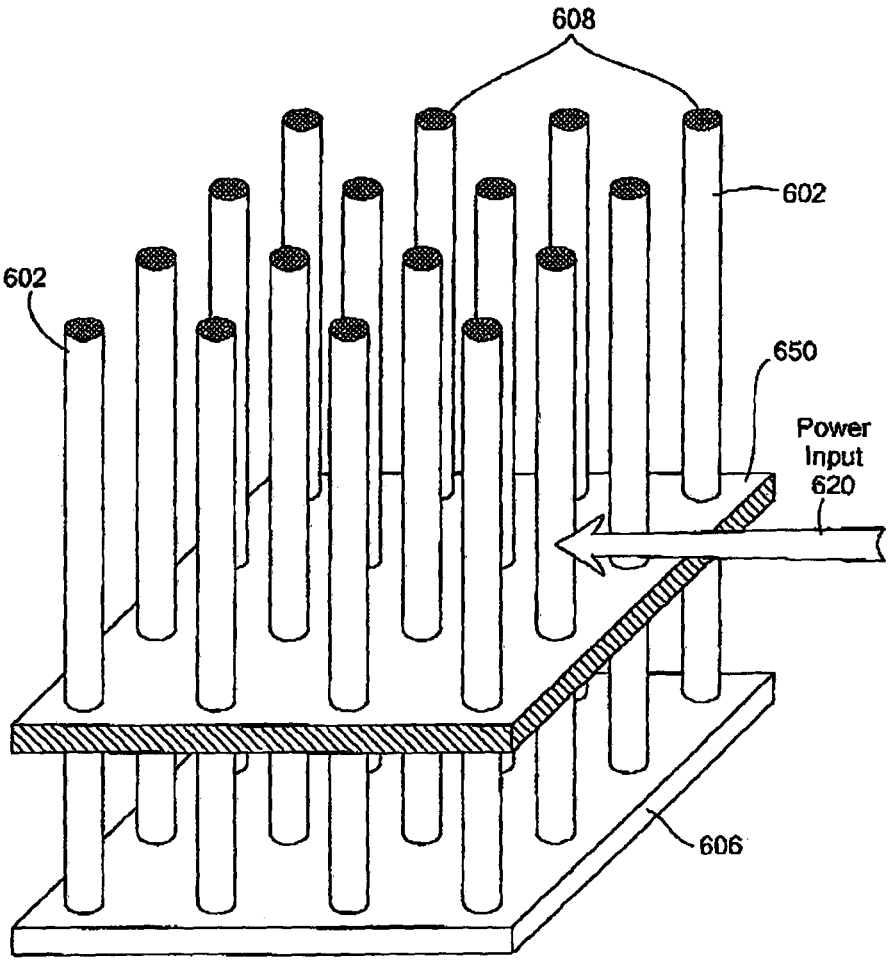

As shown in FIG. 11C, a 2D array of resonators 602 includes a coupling sheet 650 to electrically connect the resonators to one another. As described above, the coupling sheet 650 can be positioned at any point, aside from the ends, along the length of the resonators 602.

The coupling sheet 650 comprises a conductive material electrically connecting adjacent resonators. Different locations may be desirable in different situations. Typically, placing the electrical connections closer to the first end of the resonators, i.e., near the surface where plasma is generated, results in a more uniform distribution of energy in the lowest-frequency operating mode, while placing the connections closer to the second end of the resonators, i.e., closer to the ground plane, results in resonant modes that have more closely-spaced resonant frequencies. The presence of the coupling strip or coupling sheet alters the coupling coefficients $K_{im}$ among the resonators, as used in Eq. 1. The increased coupling improves uniformity and may allow for single-frequency operation. Further, a plurality of coupling strips may be implemented although the locations should be chosen carefully as there is a possibility that placement of an additional coupling strip could eliminate or distort some of the higher modes of operation.

Figure 12:
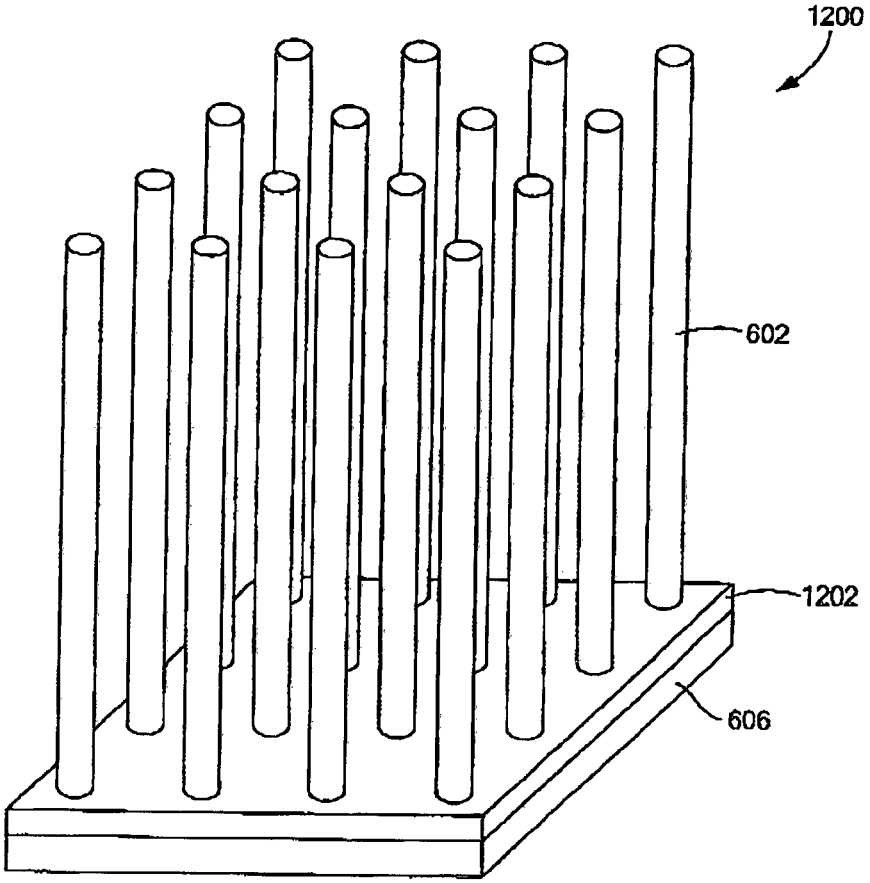
FIG. 12 is a representation of another embodiment of the microplasma generator array incorporating a logic switching plane to control the resonators.

In another embodiment of the present invention, referring now to FIG. 12, a "programmable" microplasma generator 1200 includes a logic plane 1202 placed between the quarter-wave resonators 602 and the ground plane 606. Advantageously, resonators 602 are individually connected or disconnected from the ground plane 606, i.e., turned on or off, respectively, by operation of the logic plane 1202.

Figure 13:
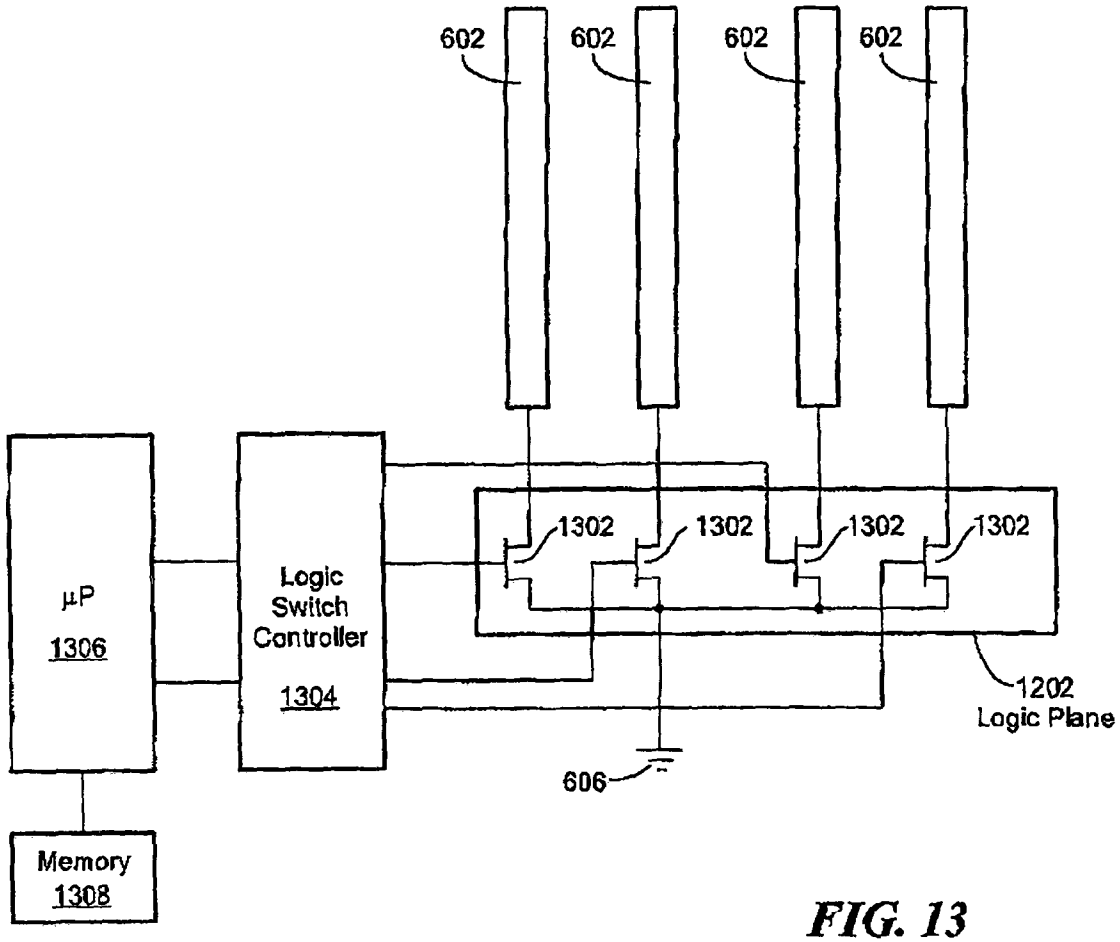
FIG. 13 is a schematic diagram of the logic switching plane shown in FIG. 12.

The logic plane 1202 comprises a plurality of power field-effect transistors (FETs) 1302 where each FET 1302 couples (or decouples) a respective resonator 602 to (from) ground 606, as shown in FIG. 13. Each FET 1302 is controlled by a logic switch controller 1304 that provides an on/off signal to a gate of a respective FET 1302. One of ordinary skill in the art will understand that there are alternate devices to FETs that could accomplish the same functionality.

Changing the connection on the end of a resonator 602 will affect its resonant frequency. Thus, opening a FET 1302 between a resonator 602 and ground 606, as depicted in FIG. 13, doubles the resonant frequency, effectively eliminating energy coupling to that resonator and extinguishing the corresponding local microplasma. In other words, each resonator 602 can be enabled or disabled. Alternately, multiple resonators can be "ganged" together and controlled by a single FET in order to provide controllable "banks" of plasma.

A microprocessor 1306 may be provided to control the logic switch controller 1304 for setting a state of each FET 1302. The microprocessor 1306 may run a program stored in a memory 1308. When a FET 1302 is configured to couple a respective resonator 602 to ground 606, the resonator is "active" but when disconnected from ground 606, it will not be capable of producing a microplasma. Thus, individual resonators 602 can be controlled and a desired microplasma pattern obtained. Of course, one of ordinary skill in the art will understand that there are other mechanisms for controlling the FETs in the logic plane. These include, but are not limited to, circuits made of analog and/or digital components, programmable devices such as ASICs and PALs and other approaches.

Figure 14:
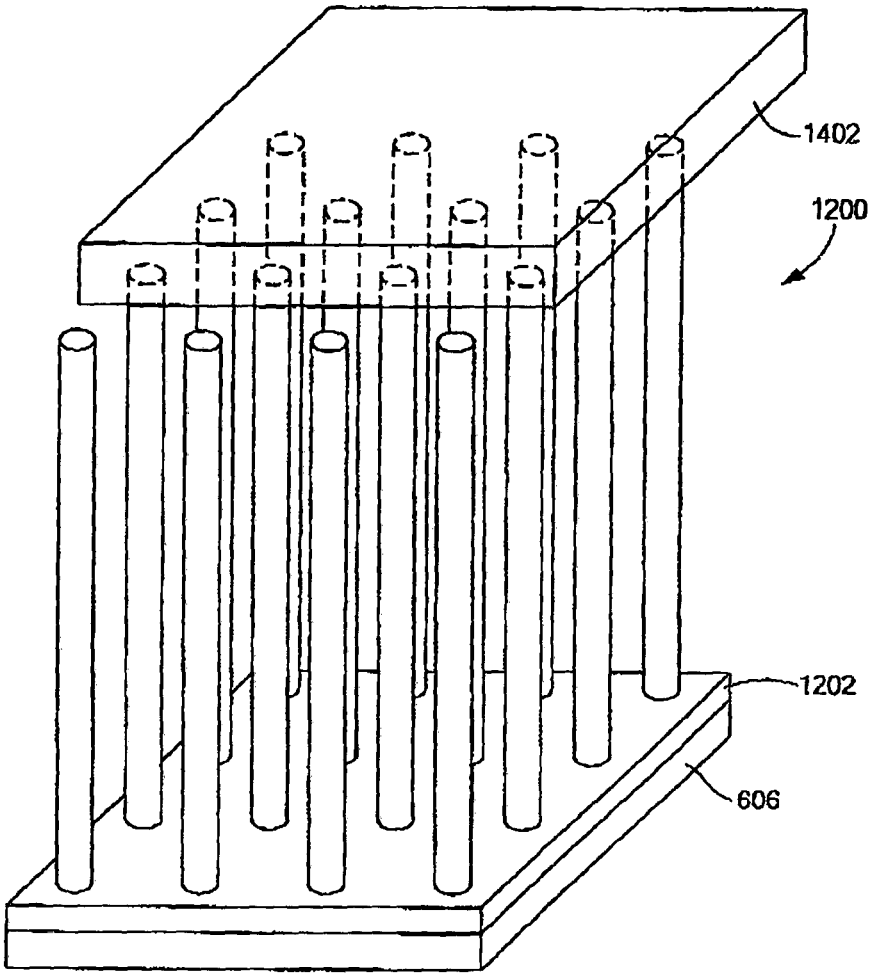
FIG. 14 is a representation of another embodiment of the present invention where a microplasma generator functions as an array of switches to reconfigure and tune mm-wave circuits.

Advantageously, as the resonators 602 can be individually turned off and on, well-defined spatial and temporal patterns of microplasmas can be used to serve as an array of high quality millimeter (mm) wave switches with a high $I_{ON}/I_{OFF}$ ratio ($I_{OFF}$ is virtually zero) and excellent isolation performance. These switches can be used to reconfigure and tune the mm-wave circuits in a signal-processing plane 1402 as shown in FIG. 14. Thus, a mm-wave signal processing IC plane 1402 will have its front side facing the microplasma array in order to sense the presence or absence of a plasma at a particular location.

The signal processing plane consists of multiplicities of any of the following circuit elements: filter, resonator, phase shifter, attenuator, coupler, mixer, etc., which are components used for processing millimeter wave signals.

The ability to tune the conductivity (and reactivity) of the microplasmas also offers the opportunity to use microplasma not just as a switch but also as an adjustable capacitive circuit element. This allows for implementing tunable filters that can change from low-pass to bandpass to high-pass behavior with minimal "reconfiguration overhead," as will be discussed below in more detail.

Figure 16:
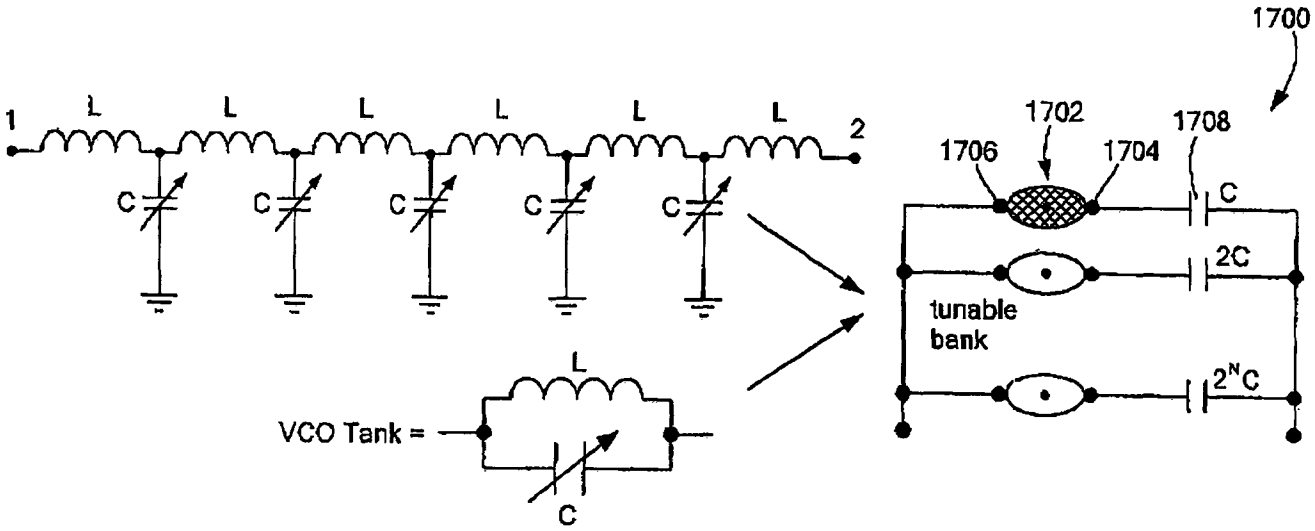
FIG. 16 is a schematic representation of another embodiment of the present invention where a microplasma generator array is part of a tunable capacitor array.

In one embodiment, a 2D array of microplasma switches utilizes microplasma as a virtual switch that can be arbitrarily positioned between any two terminals of interconnection with high $I_{ON}/I_{OFF}$ ratio ($I_{OFF}$ is almost zero) and excellent isolation. The S-parameters of these switches, their insertion loss and isolation behavior, as a function of microplasma properties, can be characterized and defined. Switches such as these can be used for reconfigurable millimeter wave front ends, tunable capacitor banks for filters and oscillators as shown in FIG. 16, and in tunable antennas. In one application, a tunable capacitor bank 1700 uses an array of microplasmas 1702 for realization of bandpass filters and voltage controlled oscillators. The presence of plasma between the two terminals 1704 and 1706 will couple in the corresponding capacitor 1708 while the absence of a microplasma will leave a connection open.

Metamaterials are artificially-designed bulk materials typically consisting of sub-wavelength metallic inclusions in dielectric media. Metamaterial absorbers and reflectors have been recently shown to be the thinnest and highest performance absorbing (or scattering) materials that depend only on the geometrical design of their unit cells and not on their material properties.

Figure 15:
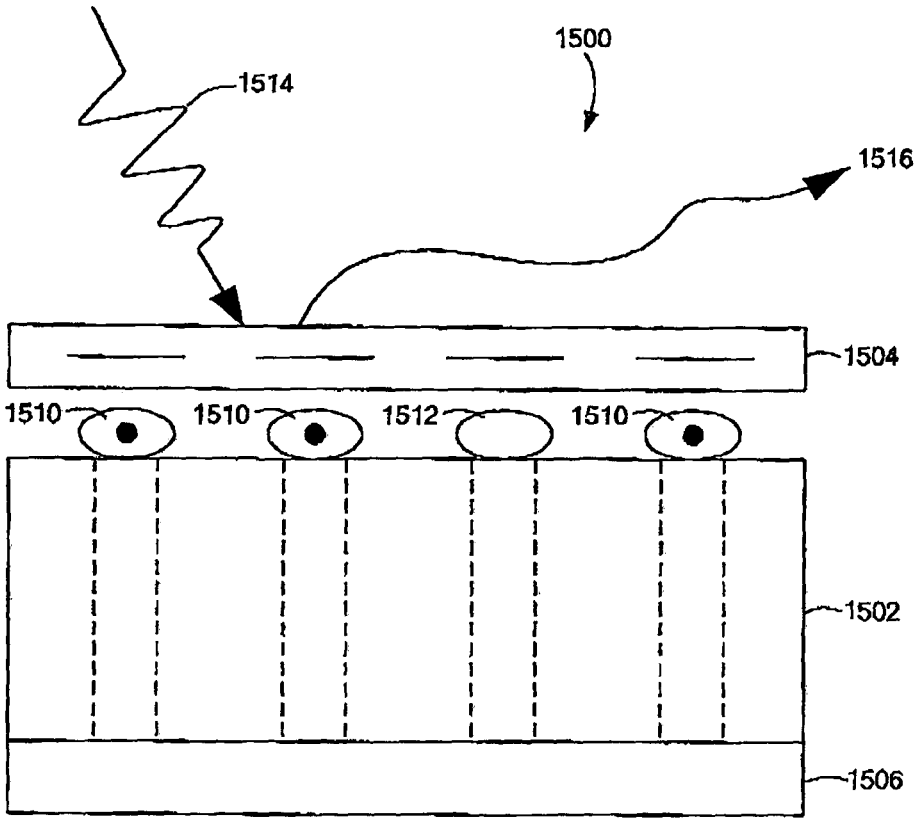
FIG. 15 is a representation of an embodiment of the present invention where a microplasma generator array functions to control a tunable absorber and reflector.

In another embodiment, metamaterials are implemented or controlled by a microplasma generator array according to an embodiment of the present invention. The metamaterial can be tailored to achieve a relatively exotic function such as, for example, operating as a so-called "perfect" absorber or reflector, an electrically small antenna, a so-called "perfect" lens, etc. Embedded microplasma generator arrays, in accordance with embodiments of the present invention, may arbitrarily adjust the absorption and reflection profile of the absorber and, therefore, be tuned over a wide frequency range. A two-dimensional microplasma generator with spatial and temporal control provides a mechanism for a widely tunable, widely programmable metamaterial with minimal reconfiguration overhead. As shown in FIG. 15, for example, a programmable reflector 1500 includes an embedded microplasma array 1502 for controlling a tunable absorber and reflector 1504. The presence 1510 or absence 1512 of a microplasma at a location will alter the electromagnetic response of the metamaterial. Thus, electromagnetic radiation 1514 impinging on the reflector 1500 may be deflected away 1516 from the source.

In one embodiment, a tunable absorber operates at 110 GHz and 230 GHz with more controlled absorption/reflection and at least 20% frequency tunability. Absorbers may be implemented in ultra-thin SOI substrates and are positioned physically over the microplasma array.

Operation of the proposed device design is robust to the influence of radiation and temperature. The array 1502 itself is similar to the 2D structures described above. The array 1502 may be driven by a single power supply, not shown, which can be shielded and cooled as appropriate. A control logic plane 1506, similar to the control logic plane 1202 described above, is placed below the surface of the discharge, shielding the transistors from the external environment.

Advantageously, the microplasma generating arrays of the present invention are capable of steady-state operation with relatively simple control circuitry. In contrast, the "flash-FET," a three-electrode discharge device described by Mitra et al., is excited by a pulsed applied voltage that requires electrode charging via leakage current that severely limits its duty cycle. A resonator array in accordance with one or more embodiments of the present invention, however, is capable of running up to steady-state duty cycles. Known commercial dielectric barrier discharge-based plasma display panels require complex control circuitry to control pixels, while in the current array, plasma control is achieved by either selection of the drive frequency or the on/off signals provided to an array of transistors. The current resonator array also will, advantageously, allow generation of microplasmas on an exterior surface, as opposed to inside a cell, easing integration into signal processing circuitry.

Figure 17:
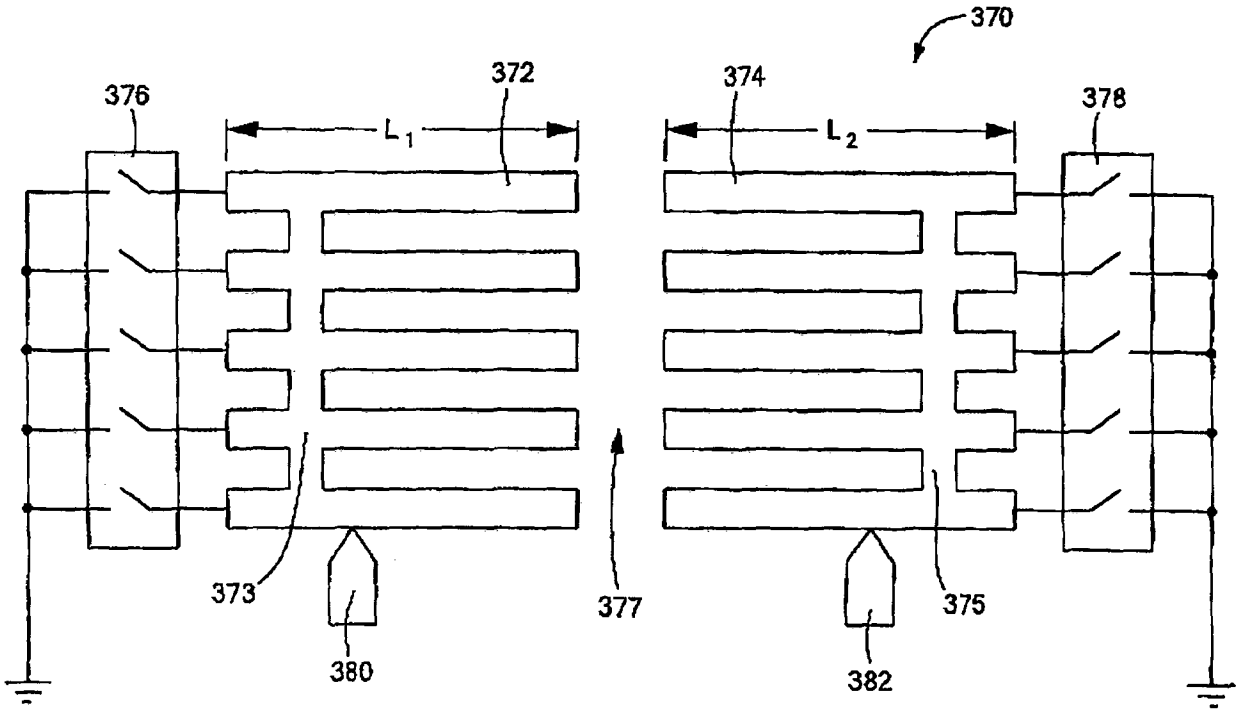
FIG. 17 is a schematic representation of another embodiment of a microplasma generator array.

In the foregoing embodiments, the resonators were configured as quarter-wave resonators. Alternatively, the resonators could be configured as half-wave resonators where the operating frequency is selected such that the length of the resonator is an integer multiple of half the wavelength of the signal. If operating at a same frequency, the half-wave resonator will be twice as long as the quarter-wave resonator. A half-wave resonator configuration differs from the quarter-wave configuration in that, in a half-wave implementation, the end of each resonator that, in a quarter-wave implementation is coupled to ground, floats. The logic control described in FIG. 13 still functions, but in the half-wave configuration the FET must be off in order for the individual resonator to operate and generate a microplasma. Another embodiment of the present invention, referring now to FIG. 17, is a microplasma generator 370 including a first plurality 372 of resonators of length L1 coupled together by a coupling strip 373. A second plurality 374 of resonators of length L2 coupled together by a coupling strip 375 is positioned opposite the first plurality 372 such that the first ends of the resonators define a gap 377 in which a plasma is generated. The second ends of the resonators of the first and second pluralities are coupled to switching elements 376, 378, respectively, to couple/decouple the ends to ground. In addition, power connectors 380, 382 are connected to one resonator of each plurality.

As the length of each resonator is fixed, the generator 370 can be operated in either half-wave or quarter-wave by coupling or decoupling the second ends to ground, through the switching elements 376, 378 and setting the power voltage to the appropriate frequency. Further, once operating, specific resonators may be turned on and off with the switching elements, as grounding the second end of a half-wave resonator will turn it off and, conversely, disconnecting the second end of a quarter-wave resonator will disable it. The lengths L1 and L2 may be equal to one another, and operated by resonant coupling or of different lengths with different supplies to provide power.

The PCT Publication No. WO2010/129277, which claims priority to U.S. Provisional Application Ser. No. 61/173,334, each of which is incorporated herein by reference in its entirety for all purposes, describes a microplasma generator that includes a plurality of strips provided opposite a respective ground electrode where power is provided directly to one of the strips. As a result of the arrangement and length of each strips, power resonates through them and a microplasma is created.

Figure 18A:
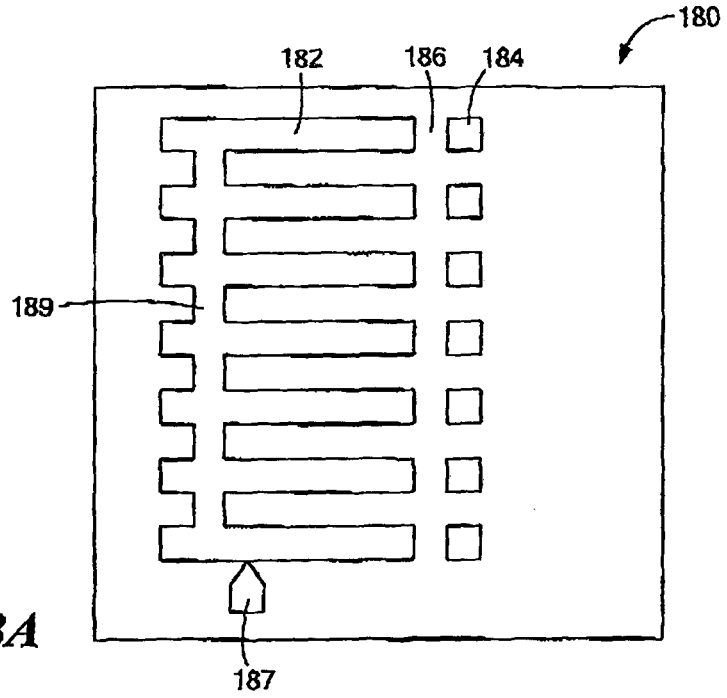
FIGS. 18A-18D are schematic representations of improvements to a known microplasma generator array.
Figure 18B:
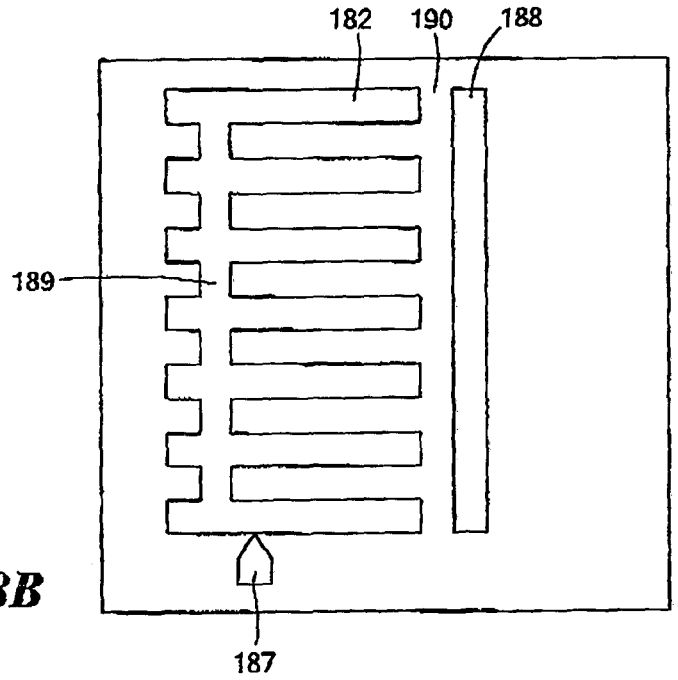

An improvement to this structure is presented in FIG. 18A where a microplasma generator 180 includes a plurality of strips 182 provided opposite a respective ground electrode 184 to provide a gap 186 in which a microplasma is generated. Power 187 is provided directly to one of the strips 182 as described above. To improve the coupling of energy, a coupling strip 189 is provided and can be positioned as has been described herein. An additional refinement is shown in FIG. 18B where a single ground electrode 188 is provided opposite the array with a coupling strip and a linear plasma is generated in a gap 190.

Figure 18C:
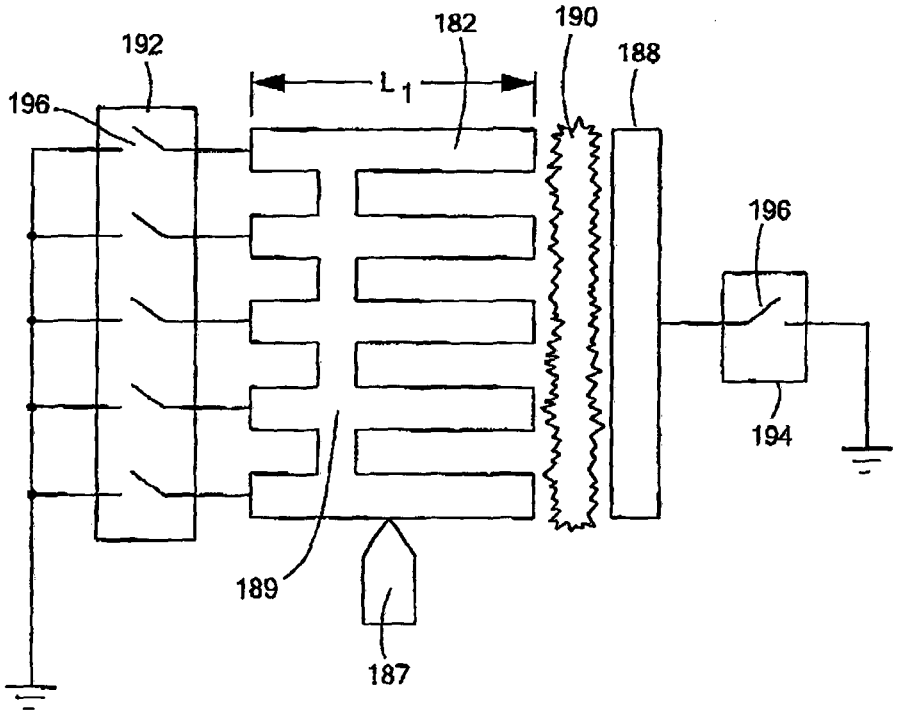
Figure 18D:
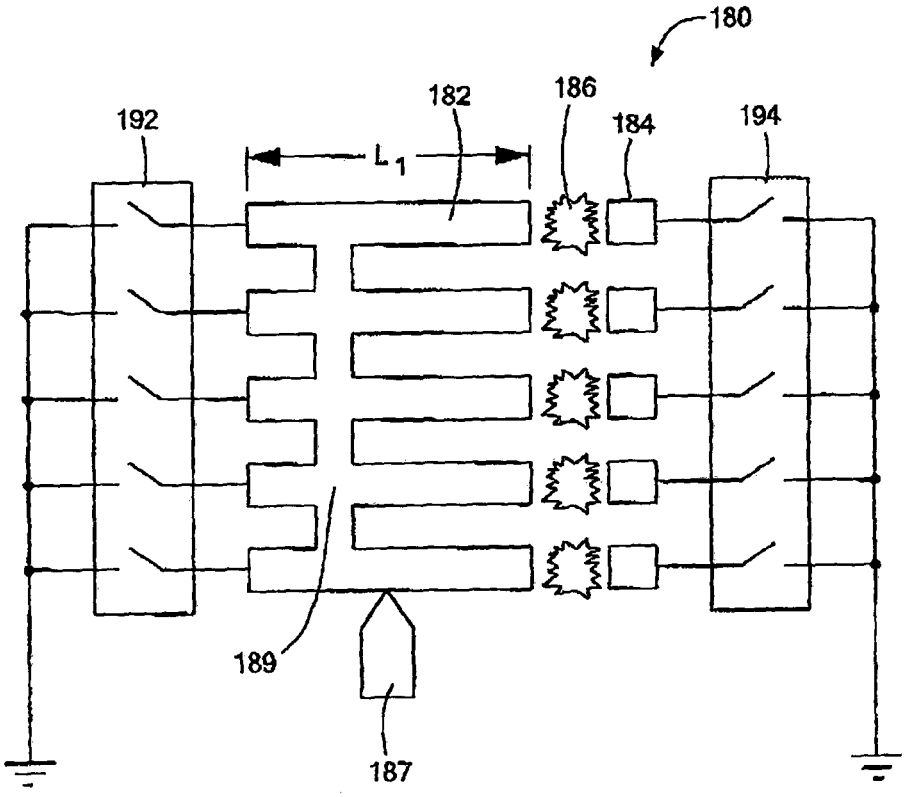

Still further, as shown in FIGS. 18C and 18D, switching element 192, as described above, may be incorporated into the design in order to couple/decouple the second ends of the resonators to/from ground to provide half-wave or quarter-wave operation and/or individual control of resonators. In addition, switching elements 194, 196 may be provided to couple/decouple a ground electrode and thereby also control microplasma generation as has been described above.

The microplasma generator devices of the present invention can be fabricated using a substrate of aluminum oxide ($Al_2O_3$), glass, or Duroid® material. In one embodiment, aluminum oxide is used due to its resistance to chemical reactions. Any dielectric that exhibits low electromagnetic loss (i.e., has a low loss tangent) is appropriate. The dielectric thickness may be between 0.1 mm and several mm. The surfaces of the dielectric layer are coated with adhesion promoting layers to ensure structural integrity to the high conductivity metals used as resonators in the embodiments using microstrips, as shown at least in, for example, FIGS. 1A, 1B and 3. For example, it is often necessary to coat glass substrates with a thin layer of chromium prior to coating with gold to improve adhesion of the gold. The metal layers should all exhibit high electrical conductivity and should not be magnetic materials. Typical metals include copper and gold.

It may be useful to coat the metal layers with a thin protective layer of dielectric (such as glass) or a refractory metal, such as tungsten, on top of the ¼ λ microstrip. In certain of the described embodiments, a second dielectric layer can be provided over the metal strips and the ground electrodes such that the metal structures of the microplasma generator are protected from the plasma. The microplasma forms on the upper surface of this protective dielectric layer. The layer can be comprised of any dielectric, though glass and aluminum oxide have properties that make their use advantageous. The thickness of this protective dielectric layer can be between, for example, 1 micrometer and 500 micrometers. Thicker protective layers will provide more protection, though the intensity of the microplasma is reduced with thicker protective layers.

The structures that comprise the metal layers of the device can be formed by, for example, (1) milling the unwanted surface layers using a circuit board prototyping tool (e.g., an LPKF circuit board milling tool can be used to pattern Duriod/copper laminates), or (2) by photolithographically defining the desired structures (according to procedures known in the electronics industry) and then etching the metal layers using acids or plasmas with the photoresist mask protecting the structures that are desired to be preserved. A further fabrication method includes defining the metal structures by photolithography directly on the dielectric substrate followed by deposition of metal on the photoresist layer. Removal of the photoresist layer leaves a metal pattern on the dielectric; this process is known as lift-off. All of these procedures are commonly practiced by the electronics industry, and in particular the microwave integrated circuit industry.

Typical feature sizes for the device are, according to some embodiments:

Gap: 1 micrometer to 1000 micrometers with a gap width in the range of 25-250 micrometers depending on the gas used (air=20 microns; argon=200 microns)

Microstrip width: 1 mm

Microstrip length: λ/4 (approximately 60 mm at 450 MHz using $Al_2O_3$; the length depends on the relative dielectric constant)

Microstrip thickness: 50 microns

Dielectric thickness: 2.5 mm

Power Frequency: 100 MHz to 10 GHz (in one embodiment, in the range of 1-3 GHz)

Power: 0.1-1.0 watts per resonator (though this parameter is gas and process dependent).

It should be appreciated that certain features, which were, for clarity, described in the context of separate embodiments, may also be provided in combination in a single embodiment. Conversely, various features of the invention, which were, for brevity, described in the context of a single embodiment, may also be provided separately or in any suitable sub-combination.

Having thus described several features of at least one embodiment of the present invention, it is to be appreciated that various alterations, modifications, and improvements will readily occur to those skilled in the art. Such alterations, modifications, and improvements are intended to be part of this disclosure and are intended to be within the scope of the invention. Accordingly, the foregoing description and drawings are by way of example only, and the scope of the invention should be determined from proper construction of the appended claims, and their equivalents.

What is claimed is:

1. A microplasma generator, comprising:

a substrate of dielectric material;

conductive strips disposed on a first surface of the substrate, each conductive strip having a first and a second end;

wherein the conductive strips are arranged radially defining a central gap between the first ends of the conductive strips;

a circular ring disposed over the conductive strips so as to cover an area adjacent to the first ends while leaving the first ends exposed;

a ground plane disposed on a second surface of the substrate;

wherein the second ends of the conductive strips are electrically coupled to the ground plane; and a power input connector coupled to a first strip of conductive strips at a first predetermined distance from the second end of the first strip, wherein the first predetermined distance is chosen as a function of the impedance of the first strip.

2. The microplasma generator of claim 1, further comprising:

a power supply, configured to provide a voltage signal, coupled to the power input connector, wherein the first predetermined distance is chosen as a function of an impedance of the power supply and such that impedance of the first strip matches impedance of the power supply.

3. The microplasma generator of claim 2, wherein:

the voltage signal has a first frequency; and a respective length of the conductive strips is chosen such that a resonant frequency of the device matches the frequency of the voltage signal.

4. The microplasma generator of claim 1, wherein a respective length of the conductive strips is chosen to be an odd integer multiple of ¼ of a wavelength (λ) traveling on each strip.

5. The microplasma generator of claim 1, wherein each of the conductive strips comprises a conductive metal.

6. The microplasma generator of claim 1, further comprising:

a first conductive via coupling the second end of the first strip to the ground plane.

7. A microplasma generator comprising:

a substrate of dielectric material;

a first plurality of conductive resonators disposed on a first surface of the substrate;

a coupling strip electrically coupling each resonator in the first plurality together;

a second plurality of conductive resonators disposed on the first surface of the substrate, wherein each resonator of the first plurality is arranged with respect to a corresponding resonator of the second plurality to define a gap between a first end of each corresponding resonator;

a ground plane disposed on a second surface of the substrate;

wherein a second end of each resonator in the first and second pluralities of resonators is electrically coupled to the ground plane; and a power input connector coupled to at least one resonator in the first plurality of resonators at a first predetermined distance from the second end of the at least one resonator, wherein the first predetermined distance is chosen as a function of an impedance of the at least one resonator.

8. The microplasma generator of claim 7, further comprising:

a power supply, configured to provide a voltage signal, coupled to the power input connector, wherein the first predetermined distance is chosen as a function of an impedance of the power supply and such that the impedance of the at least one resonator matches the power supply impedance.

9. The microplasma generator of claim 8, wherein:

the voltage signal has a first frequency; and a respective length of the resonators is chosen such that a resonant frequency of the generator matches the first frequency of the voltage signal.

10. The microplasma generator of claim 9, wherein:

the respective length of each resonator is chosen to be an odd integer multiple of ¼ of a wavelength (λ) traveling on each resonator.

11. The microplasma generator of claim 7, wherein each resonator comprises a conductive metal.

12. The microplasma generator of claim 7, further comprising:

a first plurality of vias disposed in the substrate, each via electrically coupling a second end of a respective resonator in the first plurality of resonators to the ground plane.

13. The microplasma generator of claim 7, wherein:

each resonator of the first plurality of resonators is linearly aligned with the corresponding resonator of the second plurality of resonators.

14. The microplasma generator of claim 7, wherein:

the coupling strip is a first coupling portion; and the second plurality of resonators are electrically coupled to one another by a second coupling portion.

15. The microplasma generator of claim 7, wherein the second end of each resonator in the first plurality of resonators is electrically coupled to the ground plane by a switch.

16. A microplasma generator comprising:

a block of dielectric material;

a ground plane disposed on a first surface of the block;

a plurality of spaced apart resonators disposed in the block, the resonators substantially parallel to one another;

wherein a first end of each resonator is electrically coupled to the ground plane and a second end of each resonator is exposed in a second surface of the dielectric block; and a power input connector is coupled to at least one of the resonators a first predetermined distance from the first end, wherein the first predetermined distance is chosen as a function of an impedance of the at least one resonator.

17. The microplasma generator of claim 16, further comprising:

a ground electrode disposed on the second surface of the dielectric block, the ground electrode having a plurality of openings corresponding to each resonator, and wherein the second end of each resonator is exposed in the corresponding opening.

18. The microplasma generator of claim 17, wherein each opening is substantially circular and the corresponding resonator is positioned substantially at the center of the opening.

19. The microplasma generator of claim 17, wherein the ground electrode has a predetermined thickness.

20. The microplasma generator of claim 17, wherein each opening is a same size.

21. The microplasma generator of claim 16, further comprising:

a plurality of switches, wherein each switch is coupled to the first end of a respective resonator and configured to electrically couple and decouple the respective resonator to and from the ground plane.

22. The microplasma generator of claim 21, wherein each switch is a field effect transistor.

23. The microplasma generator of claim 16, further comprising:

at least one switch coupled to the first end of at least one resonator and configured to electrically couple and decouple the at least one resonator to and from the ground plane.

24. A tunable absorber comprising:

a microplasma generator comprising:

a block of dielectric material;

a ground plane disposed on a first surface of the block;

a plurality of spaced apart resonators disposed in the block, the resonators substantially parallel to one another and each having a first end electrically coupled to the ground plane and a second end exposed in a second surface of the dielectric block;

a power input connector coupled to at least one of the resonators a first predetermined distance from the first end chosen as a function of an impedance of the at least one resonator; and a layer of metamaterial comprising metallic inclusions in a dielectric media disposed opposite the second surface of the dielectric block.

25. The microplasma generator of claim 16, further comprising a layer of metamaterial comprising metallic inclusions in a dielectric media disposed opposite the second surface of the dielectric block.

26. A microplasma generator comprising:

a substrate of dielectric material;

a plurality of conductive resonators disposed on a first surface of the substrate;

a coupling strip electrically coupling each resonator in the plurality of conductive resonators together;

a conductive strip disposed on the first surface of the substrate, wherein each resonator of the plurality of conductive resonators is arranged with respect to the conductive strip to define a gap between a first end of each corresponding resonator and the conductive strip;

a ground plane disposed on a second surface of the substrate;

wherein the ground plane and a second end of each resonator in the plurality of conductive resonators are electrically coupled to the ground plane; and a power input connector coupled to at least one resonator in the plurality of conductive resonators at a first predetermined distance from the second end of the at least one resonator, wherein the first predetermined distance is chosen as a function of an impedance of the at least one resonator.

* * * * *